US008837966B2

(12) United States Patent
Tanaka

(10) Patent No.: US 8,837,966 B2
(45) Date of Patent: Sep. 16, 2014

(54) CONTROL APPARATUS AND METHOD, IMAGE FORMING APPARATUS AND SYSTEM, AND COMPUTER READABLE MEDIUM

(75) Inventor: Satoshi Tanaka, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 218 days.

(21) Appl. No.: 13/474,209

(22) Filed: May 17, 2012

(65) Prior Publication Data

US 2013/0164002 A1 Jun. 27, 2013

(30) Foreign Application Priority Data

Dec. 22, 2011 (JP) ..... 2011-281784

(51) Int. Cl.
*G03G 15/10* (2006.01)
*G03G 15/08* (2006.01)

(52) U.S. Cl.
USPC ..... 399/59; 399/30

(58) Field of Classification Search
CPC ..... G03G 15/0849; G03G 15/0848
USPC ..... 399/30, 58, 59, 62
See application file for complete search history.

(56) References Cited

U.S. PATENT DOCUMENTS

| | | | | |
|---|---|---|---|---|
| 7,536,121 | B2 * | 5/2009 | Shimizu et al. | 399/30 X |
| 7,747,182 | B2 | 6/2010 | Kato et al. | |
| 2006/0239705 | A1 * | 10/2006 | Ishibashi | 399/49 |
| 2007/0110457 | A1 | 5/2007 | Kato et al. | |
| 2009/0202263 | A1 * | 8/2009 | Yoshida et al. | 399/49 |

FOREIGN PATENT DOCUMENTS

JP A-2007-133233 5/2007

* cited by examiner

*Primary Examiner* — Sandra Brase
(74) *Attorney, Agent, or Firm* — Oliff PLC

(57) ABSTRACT

A control apparatus includes the following elements. A toner density specifying unit specifies a toner density in a developer stored in a developing device. A toner density controller performs control such that the toner density approximates a predetermined toner density target value. A first calculator calculates a first value corresponding to an image density of an image to be output after a first timing. A correction amount specifying unit specifies a correction amount for the toner density target value at the first timing. When the condition that an absolute value of a difference between the first value and a second value is greater than a predetermined threshold is satisfied, the correction amount specifying unit specifies a smaller correction amount for the toner density target value, compared with when the condition is not satisfied. A correcting unit corrects the toner density target value on the basis of the correction amount.

8 Claims, 21 Drawing Sheets

FIG. 3

TBL1

| PRINT DATA ID | PAGE NUMBER | IMAGE DENSITY |
|---|---|---|
| 0001 | 0001 | 10% |
| | 0002 | 5% |
| | ⋮ | ⋮ |
| | 0100 | 20% |
| 0002 | 0001 | 5% |
| | 0002 | 5% |
| | ⋮ | ⋮ |
| | 0050 | 10% |
| ⋮ | ⋮ | ⋮ |

TONER DENSITY
t1
t2
TIME

TONER DENSITY
t1
t2
TIME

IMAGE DENSITY
100
200
300
400
500
600
NUMBER OF ACCUMULATED RECORDING MEDIA

CONTROL APPARATUS AND METHOD, IMAGE FORMING APPARATUS AND SYSTEM, AND COMPUTER READABLE MEDIUM

CROSS-REFERENCE TO RELATED APPLICATIONS

This application is based on and claims priority under 35 USC 119 from Japanese Patent Application No. 2011-281784 filed Dec. 22, 2011.

BACKGROUND (i) Technical Field

The present invention relates to a control apparatus and method, an image forming apparatus and system, and a computer readable medium.

(ii) Related Art

In an electrophotographic image forming apparatus, it is known that the density of images to be formed is changed in accordance with a change in the charged state of toner stored in a developing device. Accordingly, in order to suppress a change in the charged state of toner, changing of the density of toner stored in a developing device has been suggested.

SUMMARY

According to an aspect of the invention, there is provided a control apparatus including: a toner density specifying unit that specifies a toner density in a developer which includes a toner and a carrier, the developer being stored in a developing device, the developing device developing an image by using the developer so as to form a toner image; a toner density controller that performs control such that the toner density specified by the toner density specifying unit approximates a predetermined toner density target value; a first calculator that calculates a first value corresponding to an image density of an image which is to be output after a first timing; a correction amount specifying unit that specifies a correction amount for the predetermined toner density target value at the first timing, when a condition that an absolute value of a difference between the first value and a second value, which serves as a reference value, used for specifying the correction amount for the predetermined toner density target value, is greater than a predetermined threshold is satisfied, the correction amount specifying unit specifying a smaller correction amount for the predetermined toner density target value, compared with when the condition is not satisfied; and a correcting unit that corrects the predetermined toner density target value on the basis of the correction amount specified by the correction amount specifying unit.

BRIEF DESCRIPTION OF THE DRAWINGS

Exemplary embodiments of the present invention will be described in detail based on the following figures, wherein:

FIG. 3 is a diagram illustrating an example of a print data management table TBL1;

DETAILED DESCRIPTION

Exemplary embodiments of the invention will be described below with reference to the accompanying drawings.

1. First Exemplary Embodiment

1-1. Configuration

Figure 1:
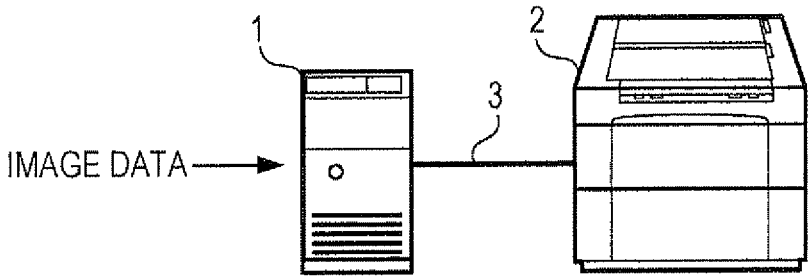
FIG. 1 illustrates an example of the hardware configuration of an image forming system according to an exemplary embodiment of the invention.

FIG. 1 illustrates an example of the configuration of an image forming system according to an exemplary embodiment of the invention. The image forming system includes, as shown in FIG. 1, an image processing apparatus 1 and an image forming apparatus 2. The image processing apparatus 1 receives image data from a client terminal (not shown), performs image processing on the received image data, and transmits the processed image data to the image forming apparatus 2. The image forming apparatus 2 receives image data from the image processing apparatus 1 and forms images on the basis of the received image data in accordance with an electrophotographic process. The image processing apparatus 1 and the image forming apparatus 2 are connected to each other via a communication line 3, such as a local area network (LAN).

The configurations of the image processing apparatus 1 and the image forming apparatus 2 will be discussed below.

Figure 2:
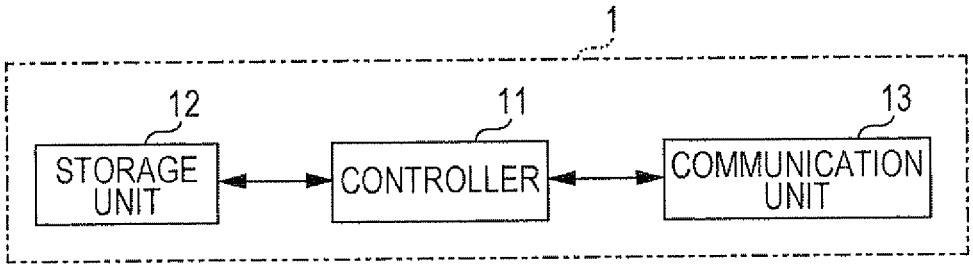
FIG. 2 is a block diagram illustrating an example of the hardware configuration of an image processing apparatus.

FIG. 2 is a block diagram illustrating an example of the hardware configuration of the image processing apparatus 1. The image processing apparatus 1 includes, as shown in FIG. 2, a controller 11, a storage unit 12, and a communication unit 13. The controller 11 includes a central processing unit (CPU), a read only memory (ROM), and a random access memory (RAM). The controller 11 controls individual components of the image processing apparatus 1 as a result of the CPU executing a program stored in the RAM or the storage unit 12. The storage unit 12 is a storage device, such as a hard disk drive (HDD), and stores image data, programs, etc., therein. The storage unit 12 also stores a print data management table TBL1 therein.

FIG. 3 is a diagram illustrating an example of the print data management table TBL1. In FIG. 3, "print data ID" is identification information appended to print data received from a client apparatus. "Page number" is a number for identifying each page in which an image is formed on the basis of print data. "Image density" is a ratio of an area occupied by effective pixels to an area of a recording medium when an image is formed on the recording medium on the basis of print data. The effective pixels are pixels forming an electrostatic latent image to be formed on a photoconductor drum 30 as a result of exposing the photoconductor drum 30 by using an exposure device 32, which will be discussed later. That is, the effective pixels are pixels to be developed by using toner. Upon receiving print data from a client apparatus via the communication unit 13, the controller 12 registers the above-described items of information concerning the print data (hereinafter referred to as "print data related information") in the print data management table TBL1.

The communication unit 13 includes an interface card and performs communication with an external apparatus.

Figure 4:
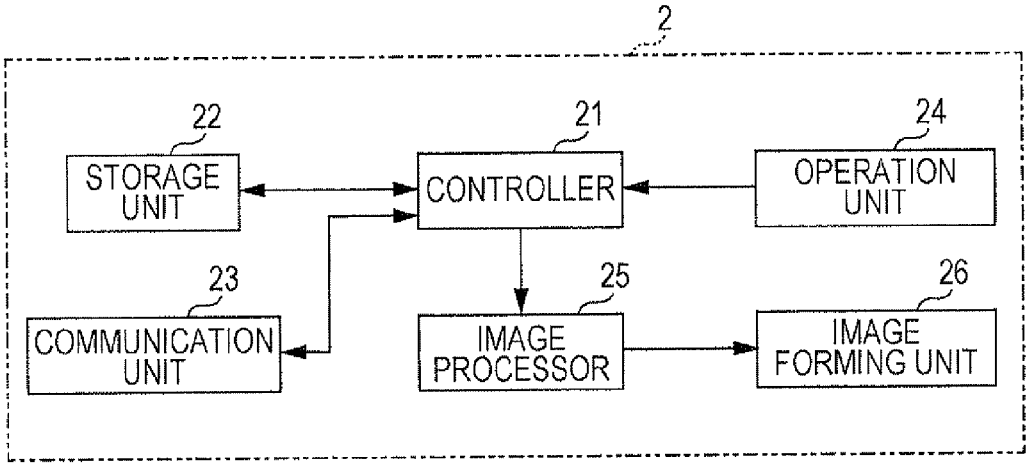
FIG. 4 is a block diagram illustrating an example of the hardware configuration of an image forming apparatus.

FIG. 4 is a block diagram illustrating an example of the hardware configuration of the image forming apparatus 2. The image forming apparatus 2 includes, as shown in FIG. 4, a controller 21, a storage unit 22, a communication unit 23, an operation unit 24, an image processor 25, and an image forming unit 26. The controller 21 includes a CPU, a ROM, and a RAM. The controller 21 controls individual components of the image forming apparatus 2 as a result of the CPU executing a program stored in the RAM or the storage unit 22. The RAM stores therein tables TBL2 and TBL 3 therein. In the table TBL2, plural items of print data related information sent from the image processing apparatus 1 are sequentially stored. Upon completion of outputting image data corresponding to the print data related information stored in TBL2, the print data related information stored in the TBL2 is transferred to the TBL3. That is, print data related information concerning image data which has not been output is stored in the TBL2, while print data related information concerning image data which has been output is stored in the TBL3.

The communication unit 23 includes an interface card and performs communication with an external apparatus. The operation unit 24 includes operation keys and a touch panel, and outputs a signal representing the content of an operation performed on the operation keys or the touch panel by the user to the controller 21.

The image processor 25 includes an integrated circuit, such as an application specific integrated circuit (ASIC), and an image memory. The image processor 25 stores image data output from the controller 21 in the image memory, and performs image processing on the image data. The image processor 25 performs, for example, tone correction processing. The tone correction processing is processing for adjusting tone characteristics of images represented by image data. The image processor 25 refers to a tone correction table stored in the storage unit 22 and converts tone values of image data into associated tone values in the tone correction table. The image processor 25 may also perform another type of image processing, such as shading correction processing.

The image forming unit 26 forms images on the basis of image data output from the image processor 25 in accordance with an electrophotographic process. The image forming unit 26 forms images on a recording medium by using four colors of toners constituted of yellow (Y), magenta (M), cyan (C), and black (K). The recording medium is recording paper, a plastic sheet, such as an overhead projector (OHP) sheet.

Figure 5:
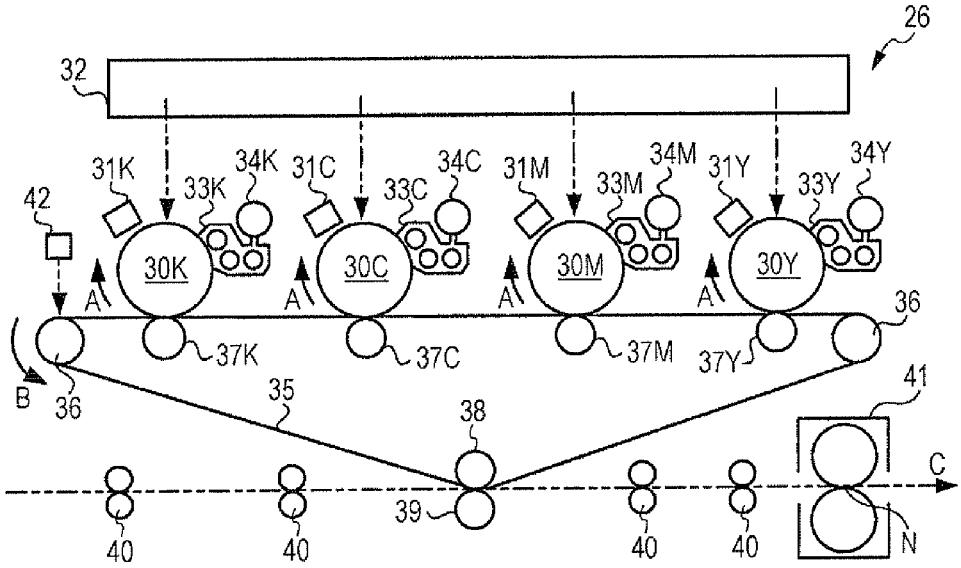
FIG. 5 illustrates an example of the configuration of an image forming unit.

FIG. 5 illustrates an example of the configuration of the image forming unit 26. In FIG. 5, alphabetical characters (Y, M, C, and K) appended to reference numerals refer to associated colors of toners used by components denoted by the corresponding reference numerals. Components having the same reference numeral and different alphabetical characters have the same configuration although the colors of toners used by the components are different. The components having the same configuration are indicated only by a reference numeral while omitting alphabetical characters appended thereto unless it is necessary to distinguish the individual components.

In FIG. 5, a recording medium transported within the image forming unit 26 is fed by a feeder (not shown), and is transported in the direction C indicated by the broken line. While the recording medium is being transported, an image is formed on the surface of the recording medium.

The photoconductor drums 30 are cylindrical members each having multilayered photoconductive films on the outer periphery thereof, and are rotatably supported. The photoconductor drums 30 are disposed such that they are in contact with an intermediate transfer belt 35, and are rotated about the centers of the cylindrical members in the direction A indicated by the arrows, in accordance with the movement of the intermediate transfer belt 35. The photoconductor drums 30 are each an example of an "image carrier" according to an exemplary embodiment of the invention.

Charging devices 31 are, for example, scorotron charging devices, and charge the photoconductive films of the associated photoconductor drums 30 at a predetermined potential. The charging devices 31 are each an example of a "charging device" according to an exemplary embodiment of the invention. An exposure device 32 exposes the associated photoconductor drums 30 charged by the charging devices 31 and forms electrostatic latent images on the photoconductor drums 30 in accordance with exposure light. The exposure device 32 exposes the photoconductor drums 30 on the basis of image data output from the controller 21. The exposure device 32 is an example of an "exposure device" according to an exemplary embodiment of the invention.

Developing devices 33 each contain a two component developer composed of one of Y, M, C, and K colors of toners and a magnetic carrier, such as ferrite powder. The developing devices 33 cause toner to adhere to electrostatic latent images formed on the associated photoconductor drums 30, thereby forming toner images. The developing devices 33 are connected to associated toner cartridges 34 via toner supply channels and receive supply of toner from the toner cartridges 34 by the rotation of dispense motors (not shown). The revolutions per minute (RPM) of the dispense motors is controlled by the controller 21 in accordance with an amount of toner to be supplied. The developing devices 33 are each an example of a "developing device" according to an exemplary embodiment of the invention.

The intermediate transfer belt 35 is an endless belt member, and is rotated in the direction B indicated by the arrow in FIG. 5 while being in contact with rotation rollers 36, first transfer rollers 37, and a backup roller 38. The rotation rollers 36 are cylindrical members that support the movement of the intermediate transfer belt 35, and are rotated about the centers of the cylinders. The first transfer rollers 37 are cylindrical members which oppose the associated photoconductor drums 30 with the intermediate transfer belt 35 therebetween. The first transfer rollers 37 each generate a potential difference between the first transfer roller 37 and the associated photoconductor drum 30 so as to transfer a toner image formed on the surface of the photoconductor drum 30 to the surface of the intermediate transfer belt 35.

A second transfer roller 39 is a cylindrical member which opposes the backup roller 38 with the intermediate transfer belt 35 therebetween. The second transfer roller 39 generates a potential difference between the second transfer roller 39 and the backup roller 38 so as to transfer the toner image on the surface of the intermediate transfer belt 35 to a recording medium. The second transfer roller 39 is an example of a "transfer device" according to an exemplary embodiment of the invention.

Transport rollers 40 are cylindrical members which are driven by a drive unit (not shown) so as to transport a recording medium in the direction C indicated by the broken line in FIG. 5. The transport rollers 40 are rotated such that a recording medium is transported at a predetermined transport speed.

A fixing device 41 includes a fixing roller and a pressurizing roller. The fixing device 41 performs fixing processing for heating and pressurizing a recording medium on which a toner image is transferred, in a region N sandwiched between the fixing roller and the pressurizing roller, thereby fixing the toner image on the recording medium.

A density sensor 42 is a unit for optically reading a toner image formed on the intermediate transfer belt 35. Upon reading a toner image formed on the intermediate transfer belt 35, the density sensor 42 outputs a signal representing the density of the read toner image to the controller 21. The density of the toner image is obtained by dividing an amount of light applied to the toner image by the density sensor 42 by an amount of light reflected by the toner image and received by the density sensor 42.

The density sensor 42 may be disposed such that it reads a toner image formed on the photoconductor drum 30 or a toner image formed on a recording medium.

Figure 6:
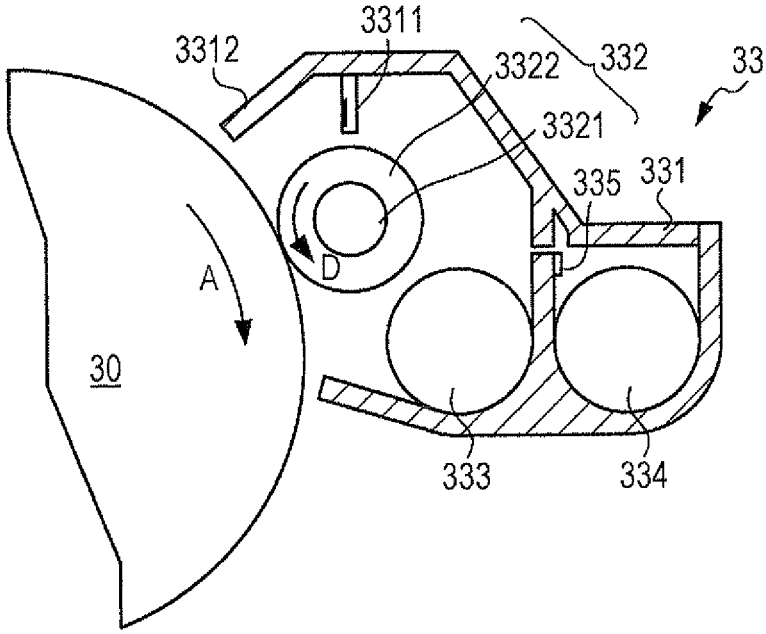
FIG. 6 is an enlarged view illustrating a developing device and a photoconductor drum.

FIG. 6 is an enlarged view illustrating the developing device 33 and the photoconductor drum 30. The developing device 33 includes, as shown in FIG. 6, a developing roller 332, a supply roller 333, an agitator member 334, and a toner density sensor 335 within a casing 331. The developing roller 332 is a cylindrical member disposed at an opening of the casing 331 adjacent to the photoconductor drum 30. The developing roller 332 includes a magnet roller 3321 fixed to the inside of the developing roller 332 and a developing sleeve 3322 disposed rotatably around the outer periphery of the magnet roller 3321. The magnet roller 3321 receives a developing bias applied from a power source (not shown) and thereby generates a magnetic field for retaining a developer on the periphery of the developing roller 332.

The developing sleeve 3322 is a nonmagnetic sleeve and is rotated in the direction D indicated by the arrow in FIG. 6. The developing sleeve 3322 retains a developer thereon due to a magnetic attraction force of the magnet roller 3321 while being rotated. The developer to be retained on the developing sleeve 3322 forms a so-called magnetic brush in which the developer is disposed along the magnetic lines of flux due to a magnetic force applied from the magnet roller 3321. The layer thickness of the magnetic brush is controlled by a layer thickness regulating member 3311. A cover 3312 forming the casing 331 prevents a developer from scattering from the developing roller 332 or the photoconductor drum 30.

The supply roller 333 is a cylindrical member which is disposed farther backward than the developing roller 332 within the casing 331. The supply roller 333 supplies a developer to the surface of the developing roller 332 while agitating the developer within the casing 331. The agitator member 334 is a spiral rotator disposed farther backward than the supply roller 333. The agitator member 334 agitates and transports a developer within the casing 331. The toner density sensor 335 is a sensor for measuring the toner density (the ratio of toner to the developer) within the casing 331 and is provided on a partitioning plate which partitions the supply roller 333 and the agitator member 334. The toner density sensor 335 measures the permeability of the developer within the casing 331 and outputs a signal representing the measured permeability to the controller 21.

The toner density sensor 335 may be an optical sensor that measures toner density by applying light to a developer on the developing sleeve 3322.

The configuration of the image forming unit 26 has been discussed above.

Figure 7:
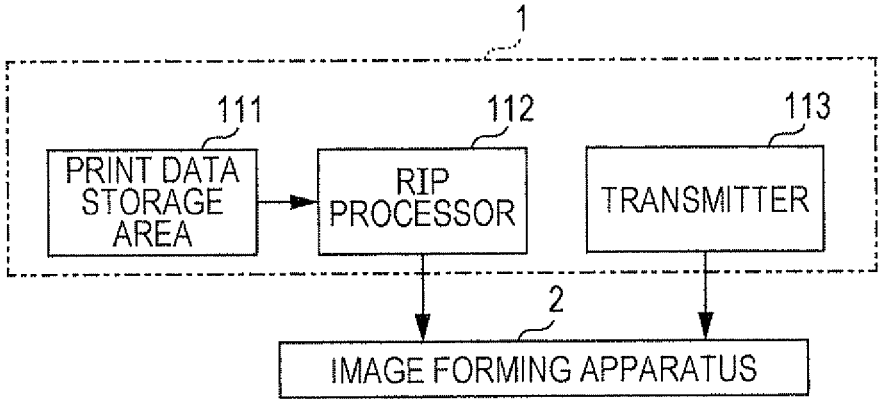
FIG. 7 is a functional block diagram illustrating an example of the functional configuration of the image processing apparatus.

The functional configuration of the image forming system according to this exemplary embodiment will now be described below. FIG. 7 is a functional block diagram illustrating an example of the functional configuration of the image processing apparatus 1. The functional blocks shown in FIG. 7 are implemented as a result of the CPU executing an image processing program stored in the ROM of the controller 11. The image processing program is a program for performing image processing on print data sent from a client terminal.

A print data storage area 111 is an area in which plural items of print data sent from a client terminal and to be subjected to raster image processing (RIP), which will be discussed later, are temporarily and sequentially stored. The print data includes image data described in a page description language (PDL) (hereinafter referred to as "PDL data") and print control information. The print control information concerns, for example, the image density of each page.

A RIP processor 112 reads PDL data among plural items of print data stored in the print data storage area 111 and interprets the read PDL data, thereby generating raster data in units of pages. The raster data generated by the RIP processor 112 is sent to the image forming apparatus 2 via the communication line 3, together with the associated print data ID and page numbers.

The transmitter 113 transmits print data related information registered in the print data management table TBL1 to the image forming apparatus 2. For example, the transmitter 113 transmits, in synchronization with the reading of PDL data by the RIP processor 112, print data related information associated with the PDL data to the image forming apparatus 2.

The functional configuration of the image processing apparatus 1 has been discussed above.

Figure 8:
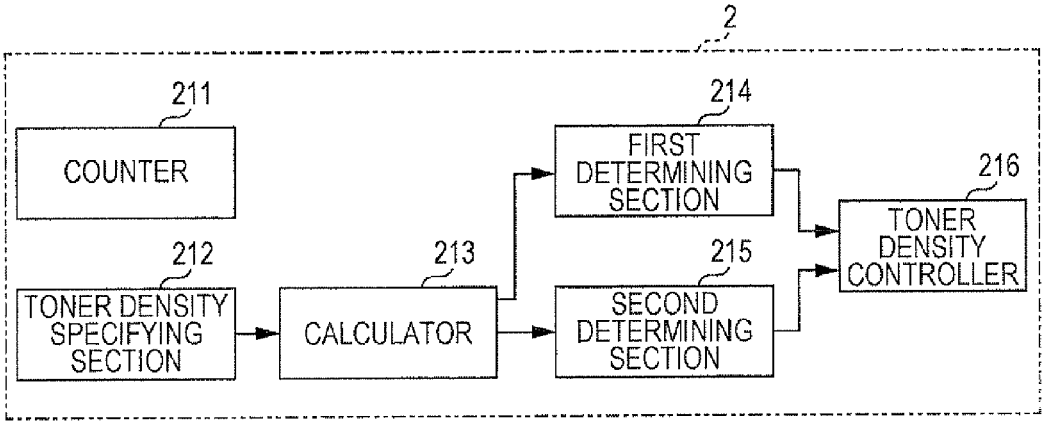
FIG. 8 is a functional block diagram illustrating an example of a first functional configuration of the image forming apparatus.

FIG. 8 is a functional block diagram illustrating an example of a first functional configuration of the image forming apparatus 2. The functional blocks shown in FIG. 8 are implemented as a result of the CPU executing a toner density control processing program stored in the ROM of the controller 21. The toner density control processing program is a program for controlling the toner density within the developing device 33 such that the toner density approximates a toner density target value.

A counter 211 counts the number of recording media on which images are formed on the surfaces thereof. A toner density specifying section 212 specifies a value of the toner density within the developing device 33 on the basis of a signal output from the toner density sensor 335. The value of the toner density may be a value representing the ratio of toner to the developer or a value represented by a signal (i.e., a value representing an amount of carrier in the developer) output from the toner density sensor 335. The toner density specifying section 212 is an example of a "toner density specifying unit" according to an exemplary embodiment of the invention. A calculator 213 compares a toner density value specified by the toner density specifying section 212 with a predetermined toner density target value stored in the RAM, and calculates the difference between the two values ("toner density target value"–"toner density value").

A first determining section 214 determines whether the difference calculated by the calculator 213 is a positive value. This determination is made in order to determine whether the toner density value is lower than the toner density target value. A second determining section 215 determines whether the difference calculated by the calculator 213 is a negative value. This determination is made in order to determine whether the toner density value exceeds the toner density target value.

A toner density controller 216 performs control for changing the toner density on the basis of a determination made by the first determining section 214 or the second determining section 215. More specifically, if the determination result of the first determining section 214 is positive (i.e., if the toner density value is lower than the toner density target value), the toner density controller 216 instructs the image forming unit 26 to supply toner. In this case, the amount of toner to be supplied is determined on the basis of the tables stored in the storage unit 22 and the difference calculated by the calculator 213.

In contrast, if the determination result of the second determining section 215 is positive (i.e., the toner density value exceeds the toner density target value), in order to reduce the amount of toner, the toner density controller 216 instructs the image forming unit 26 to intentionally consume toner. More specifically, the toner density controller 216 instructs the image forming unit 26 to form patch images used for intentionally consuming toner. In this case, the amount of toner to be consumed is determined on the basis of the tables stored in the storage unit 22 and the difference calculated by the calculator 213. The toner density controller 216 is an example of a "toner density controller" according to an exemplary embodiment of the invention.

The first functional configuration of the image forming apparatus 2 has been discussed above.

Figure 9:
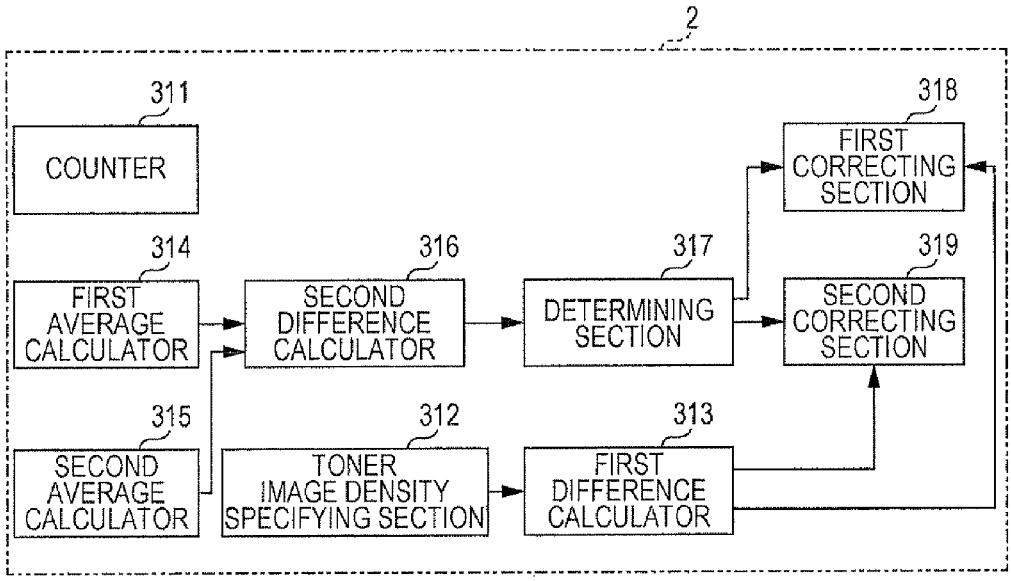
FIG. 9 is a functional block diagram illustrating an example of a second functional configuration of the image forming apparatus.

FIG. 9 is a functional block diagram illustrating an example of a second functional configuration of the image forming apparatus 2. The functional blocks shown in FIG. 9 are implemented as a result of the CPU executing a toner density target value correction processing program stored in the ROM of the controller 21. The toner density target value correction processing program is a program for correcting a toner density target value on the basis of the toner image density detected by the density sensor 42.

A counter 311 counts the number of recording media on which image are formed on the surfaces thereof. A toner image density specifying section 312 specifies a density value of a toner image to be formed on the intermediate transfer belt 35. More specifically, the toner image density specifying section 312 instructs the image forming unit 26 to form a patch image and the density sensor 42 to read the formed patch image. The toner image density specifying section 312 specifies the density value of the toner image on the basis of a signal output from the density sensor 42. A first difference calculator 313 calculates the difference between the toner image density value specified by the toner image density specifying section 312 and a predetermined toner image density target value stored in the storage unit 22 ("toner image density target value"–"toner image density value").

A first average calculator 314 calculates a value (e.g., an average) corresponding to the image density levels of plural images which have been output. The plural images are images which have been output before an amount by which the toner density target value is corrected by a second correcting section 319, which will be discussed later. More specifically, the first average calculator 314 reads image density values of images for, for example, 100 pages, from the table TBL3 stored in the RAM, and calculates the average of the image density values. The first average calculator 314 is an example of a "second calculator" according to an exemplary embodiment of the invention. A second average calculator 315 calculates a value (e.g., an average) corresponding to the image density levels of plural images which will be output. The plural images are images which will be output after an amount by which the toner density target value is corrected by the second correcting section 319, which will be discussed later. More specifically, the second average calculator 315 reads image density values of images for, for example, 100 pages, from the table TBL2 stored in the RAM, and calculates the average of the image density values. The second average calculator 315 is an example of a "first calculator" according to an exemplary embodiment of the invention.

A second difference calculator 316 calculates the difference between a first average calculated by the first average calculator 314 and a second average calculated by the second average calculator 315 ("first average value"–"second average value"). A determining section 317 determines whether the absolute value of the difference calculated by the second difference calculator 316 is greater than a predetermined threshold stored in the storage unit 22. This determination is made in order to determine whether a change in image density between images that have been output and images that will be output is greater than the predetermined threshold.

If the determination result of the determining section 317 is positive, a first correcting section 318 corrects a tone correction table. More specifically, the first correcting section 318 specifies a correction amount on the basis of the difference calculated by the first difference calculator 313 and the tables stored in the storage unit 22, and corrects the tone correction table on the basis of the specified correction amount. If the determination of the determining section 317 is negative, the second correcting section 319 corrects the toner density target value. More specifically, the second correcting section 319 specifies a correction amount on the basis of the difference calculated by the first difference calculator 313 and the tables stored in the storage unit 22, and corrects the toner density target value on the basis of the specified correction value.

The second functional configuration of the image forming apparatus 2 has been discussed above.

1-2. Operation

A description will now be given of processing performed by the image forming apparatus 2 according to the first exemplary embodiment. More specifically, (a) toner density control processing and (b) toner density target value correction processing will be described. The (a) toner density control processing and (b) toner density target value correction processing are performed as a result of the CPU executing the associated programs stored in the ROM of the image forming apparatus 2. The (a) toner density control processing and (b) toner density target value correction processing are performed concurrently with image forming processing performed by the image forming unit 26, and are performed in each of the developing devices 33 of the individual colors.

1-2-1. Toner Density Control Processing

Figure 10:
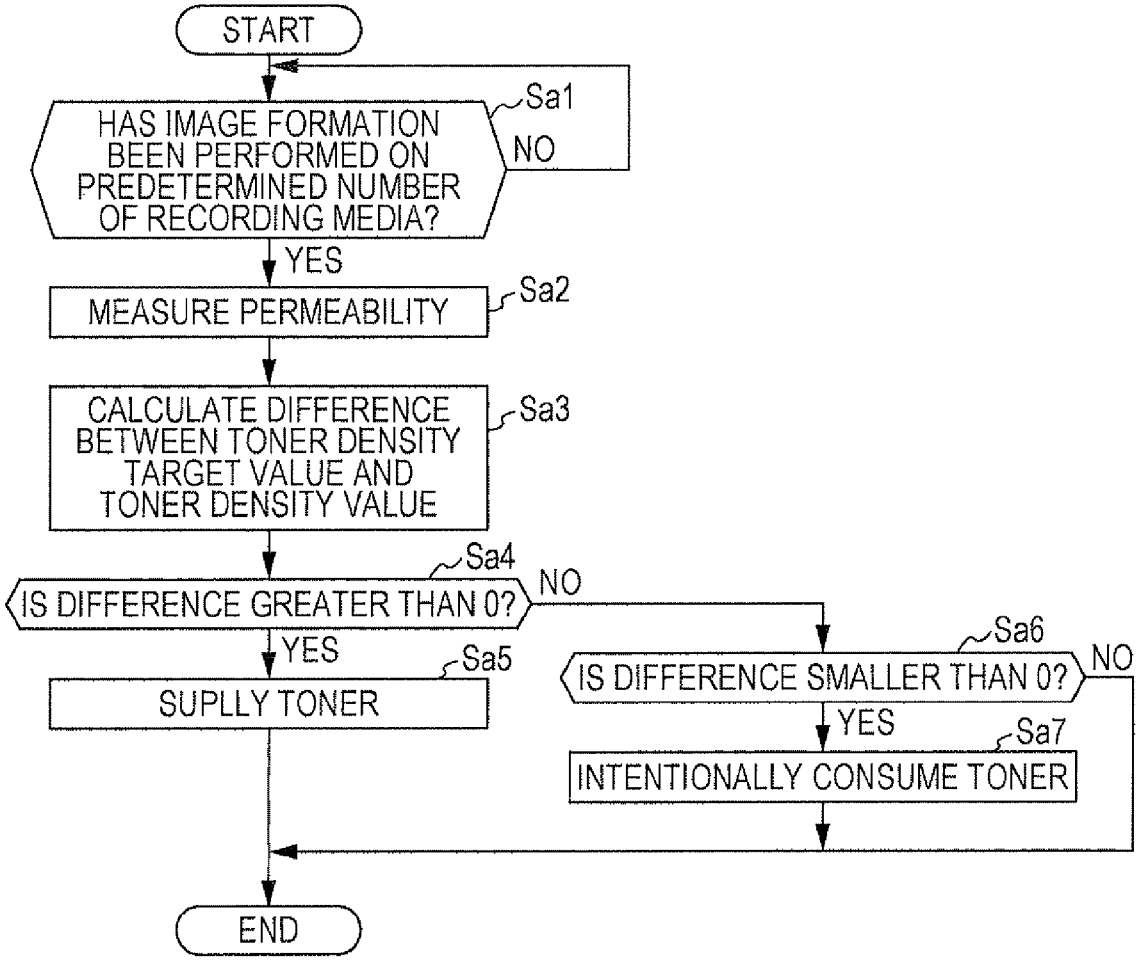
FIG. 10 is a flowchart illustrating toner density control processing.

FIG. 10 is a flowchart illustrating toner density control processing. This processing is performed in order to perform control such that the toner density within the developing device 33 approximates a toner density target value. In step Sa1, the controller 21 of the image forming apparatus 2 determines whether image formation has been performed on a predetermined number of recording sheets. For example, the controller 21 determines whether image formation has been performed on ten recording sheets.

If it is determined in step Sa1 that image formation has not been performed on a predetermined number of recording sheets (if the result of step Sa1 is NO), the controller 21 executes step Sa1 again. That is, the controller 21 enters the standby state until image formation has been performed on a predetermined number of recording sheets. In contrast, if it is determined in step Sa1 that image formation has been performed on a predetermined number of recording sheets (if the result of step Sa1 is YES), the process proceeds to step Sa2. In step Sa2, the controller 21 instructs the toner density sensor 335 to measure the permeability.

Then, in step Sa3, the controller 21 compares a toner density value specified from a signal output from the toner density sensor 335 with a toner density target value, and calculates the difference between the toner density value and the toner density target value ("toner density target value"–"toner density value"). The controller 21 then determines in step Sa4 whether the calculated difference is a positive value. If it is determined in step Sa4 that the calculated difference is a positive value (i.e., if the toner density value is lower than the toner density target value), the process proceeds to step Sa5. In step Sa5, the controller 21 instructs the image forming unit 26 to supply toner.

If it is determined in step Sa4 that the calculated difference is not a positive value (if the result of step Sa4 is NO), the process proceeds to step Sa6. The controller 21 determines in step Sa6 whether the calculated value is a negative value. If it is determined in step Sa6 that the calculated difference is a negative value (i.e., if the toner density value exceeds the toner density target value), the process proceeds to step Sa7. In step Sa7, the controller 21 instructs the image forming unit 26 to intentionally consume toner.

If it is determined in step Sa6 that the calculated difference is not a negative value (i.e., if the calculated difference is 0), the controller 21 terminates the toner density control processing.

The toner density control processing has been discussed above.

1-2-2. Toner Density Target Value Correction Processing

Figure 11:
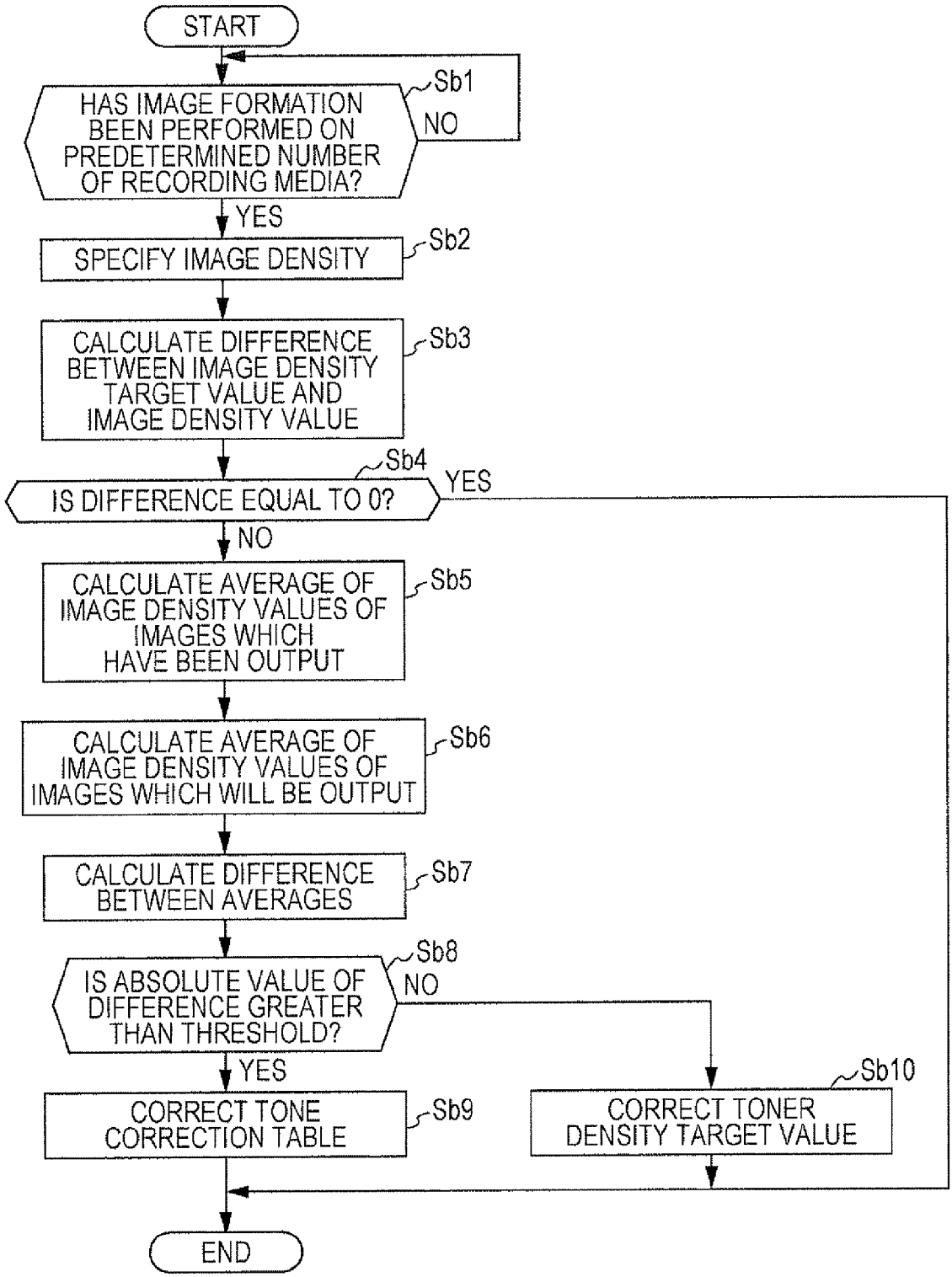
FIG. 11 is a flowchart illustrating toner density target value correction processing.

FIG. 11 is a flowchart illustrating toner density target value correction processing. This processing is performed in order to correct a toner density target value on the basis of a toner image density detected by the density sensor 42. In step Sb1, the controller 21 of the image forming apparatus 2 determines whether image formation has been performed on a predetermined number of recording sheets. For example, the controller 21 determines whether image formation has been performed on ten recording sheets.

If it is determined in step Sb1 that image formation has not been performed on a predetermined number of recording sheets (if the result of step Sb1 is NO), the controller 21 executes step Sb1 again. That is, the controller 21 enters the standby state until image formation has been performed on a predetermined number of recording sheets. In contrast, if it is determined in step Sb1 that image formation has been performed on a predetermined number of recording sheets (if the result of step Sb1 is YES), the process proceeds to step Sb2. In step Sb2, the controller 21 specifies a density value of a toner image. More specifically, the controller 21 instructs the image forming unit 26 to form a patch image and the density sensor 42 to read the formed patch image. The controller 21 then specifies a density value of the toner image on the basis of a signal output from the density sensor 42.

Then, in step Sb3, the controller 21 compares the specified density value of the toner image with a predetermined toner image density target value, and calculates the difference between the two values ("toner image density target value"–"toner image density value"). The controller 21 then determines in step Sb4 whether the calculated difference is 0. If it is determined in step Sb4 that the calculated difference is 0 (if the result of step Sb4 is YES), the controller 21 terminates the toner density target value correction processing. If it is determined in step Sb4 that the calculated difference is not 0 (if the result of step Sb4 is NO), the process proceeds to step Sb5.

In step Sb5, the controller 21 calculates a first average of the image density levels of plural images which have been output. More specifically, the controller 21 reads image density values of images for, for example, 100 pages, from the table TBL3 stored in the RAM, and calculates the average of the image density values. Then, in step Sb6, the controller 21 calculates a second average of the image density levels of plural images which will be output. More specifically, the controller 21 reads image density values of images for, for example, 100 pages, from the table TBL2 stored in the RAM, and calculates the average of the image density values.

In step Sb7, the controller 21 calculates the difference between the first average value calculated in step Sb5 and the second average value calculated in step Sb6 ("first average value"–"second average value"). The controller 21 then determines in step Sb8 whether the absolute value of the calculated difference is greater than a predetermined threshold. That is, the controller 21 determines in step Sb8 whether a change in image density between images that have been output and images that will be output is greater than the predetermined threshold. If it is determined in step Sb8 that the absolute value of the calculated difference is greater than the predetermined threshold (if the result of step Sb8 is YES), the process proceeds to step Sb9. In step Sb9, the controller 21 corrects the tone correction table, instead of correcting the toner density target value. More specifically, the controller 21 specifies a correction amount for the tone correction table on the basis of the difference calculated in step Sb3 and the tables stored in the storage unit 22, and corrects the tone correction table on the basis of the specified correction amount.

The reason for this is as follows. If the absolute value of the calculated difference is greater than the predetermined threshold (i.e., if a change in image density between images that have been output and images that will be output is greater than the predetermined threshold), it is predicted that, even if the toner density target value is corrected now, it may be necessary to correct the toner density target value again since the image density may be changed again. For example, even if the toner density target value is increased now, it may have to be decreased, and vice versa. In practice, however, it is still necessary to correct the density of images which will be output since the current toner density deviates from the toner density target value. Accordingly, correction of the tone correction table, which takes less time to change the density of images than the correction of the toner density, and which does not waste toner, will be performed.

If it is determined in step Sb8 that the absolute value of the calculated difference is not greater than the predetermined threshold (if the result of step Sb8 is NO), the process proceeds to step Sb10. In step Sb10, the controller 21 corrects the toner density target value. More specifically, the controller 21 specifies a correction amount for the toner density target value on the basis of the difference calculated in step Sb3 and the tables stored in the storage unit 22, and corrects the toner density target value on the basis of the specified correction amount. The reason for this is as follows. If the absolute value of the calculated difference is not greater than the predetermined threshold (if a change in image density between images which have been output and images which will be output is not greater than the predetermined threshold), it is unlikely that the image density will be changed, and even if the toner density target value is changed, it is unlikely that it will be necessary to correct the toner density target value again.

The toner density target value correction processing has been discussed above.

Figures 12A, 12B, 12C:
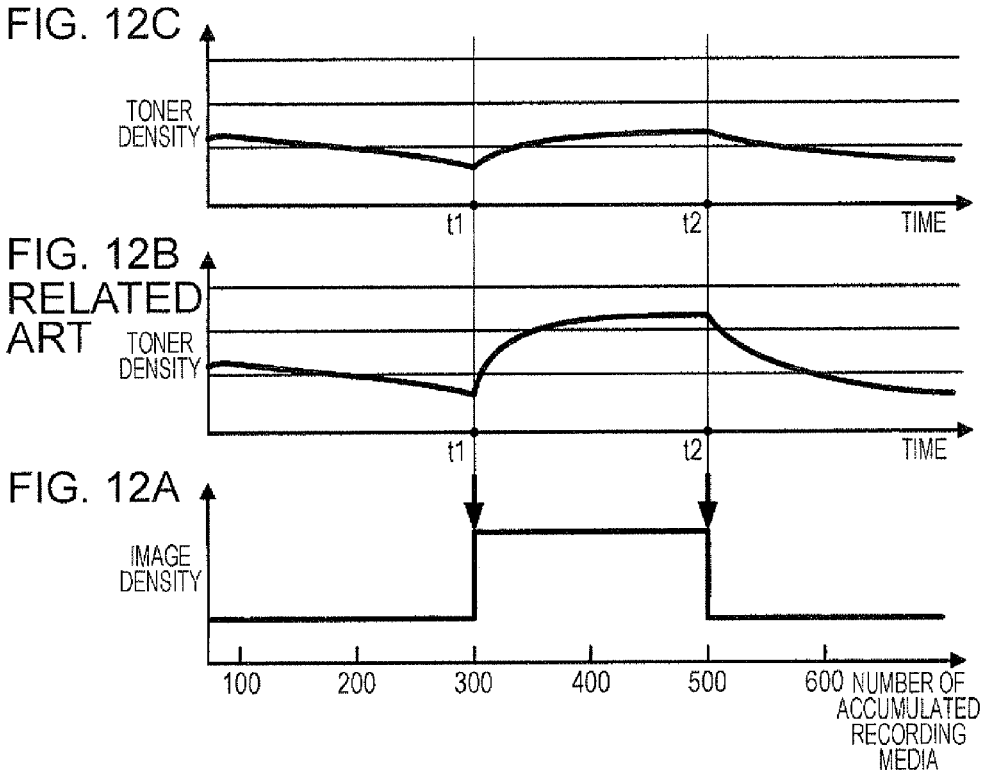
FIG. 12B RELATED ART
FIGS. 12A, 12B, and 12C are diagrams illustrating the image density, the transition of the toner density when known toner density target value correction processing is performed, and the transition of the toner density when the toner density target value correction processing of a first exemplary embodiment is performed.

FIG. 12A is a diagram illustrating the transition of the image density. FIG. 12B is a diagram illustrating the transition of the toner density when known toner density target value correction processing is performed. FIG. 12C is a diagram illustrating the transition of the image density when the toner density target value correction processing of the first exemplary embodiment is performed. The known toner density target value correction processing is performed in order to correct the toner density target value by only considering the image density of images that have been output.

Assume that toner density target value correction processing is performed at time point t1 in FIGS. 12B and 12C. In the known toner density target value correction processing, since only the image density of images that have been output is considered, if it is determined that images which have been output are low density images, correction is made such that the toner density target value is increased. In contrast, in the toner density target value correction processing of the first exemplary embodiment, by considering the image density of images which will be output, as well as the image density of images which have been output, if a change in image density between images which have been output and images which will be output is greater than the predetermined threshold, the toner density target value is not corrected. Accordingly, if the image density is changed, as shown in FIG. 12A, the toner density target value is not corrected, and as a result, a rise in the toner density caused by the correction of the toner density target value does not occur.

Assume that toner density target value correction processing is performed at time point t2 in FIGS. 12B and 12C. In the known toner density target value correction processing, since only the image density of images that have been output is considered, if it is determined that images which have been output are high density images, correction is made such that the toner density target value is decreased. In contrast, in the toner density target value correction processing of the first exemplary embodiment, by considering the image density of images which will be output, as well as the image density of images which have been output, if a change in image density between images which have been output and images which will be output is greater than the predetermined threshold, the toner density target value is not corrected. Accordingly, if the image density is changed, as shown in FIG. 12A, the toner density target value is not corrected, and as a result, a drop in the toner density caused by the correction of the toner density target value does not occur. Thus, by performing the toner density target value correction processing of this exemplary embodiment, a change in the toner density caused by the correction of the toner density target value is suppressed. As a result, intentional consumption of toner for the purpose of decreasing the toner density is avoided, thereby preventing toner from being wasted.

2. Second Exemplary Embodiment

In the above-described first exemplary embodiment, a determination as to whether the toner density target value is to be corrected on the basis of the toner image density is made on the basis of a change in image density between images that have been output and images that will be output. As a result, a change in the toner density caused by the correction of the toner density target value is suppressed. In contrast, in a second exemplary embodiment, a developing bias is corrected on the basis of the toner image density, and the toner density target value is corrected on the basis of the developing bias. Then, a threshold which is referred to when a determination is made whether to correct the toner density target value is corrected on the basis of a change in image density between images which have been output and images which will be output. Accordingly, the threshold is changed depending on the above-described change in image density, and thus, it is less likely that the toner density target value will be corrected. As a result, a change in the toner density caused by the correction of toner density target value is suppressed. The second exemplary embodiment will be discussed below.

2-1. Configuration

The overall configuration of an image forming system according to the second exemplary embodiment is the same as that of the first exemplary embodiment. Accordingly, an explanation of the overall configuration of the image forming system will be omitted. The hardware configuration of the image processing apparatus 1 and that of the image forming apparatus 2 according to the second exemplary embodiment are also the same as those of the first exemplary embodiment. Accordingly, an explanation of the hardware configurations of the image processing apparatus 1 and the image forming apparatus 2 will also be omitted. The functional configuration of the image forming system according to the second exemplary embodiment will be described below.

Figure 13:
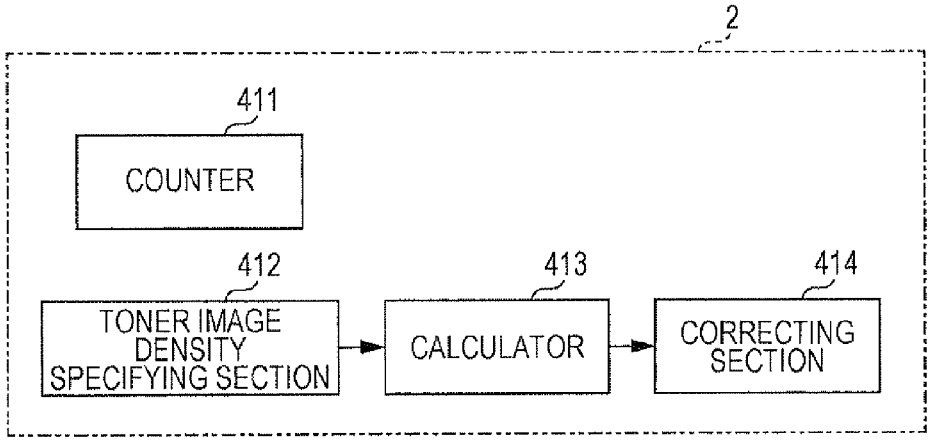
FIG. 13 is a functional block diagram illustrating an example of a first functional configuration of the image forming apparatus according to a second exemplary embodiment.

The functional configuration of the image processing apparatus 1 is the same as that of the first exemplary embodiment, and thus, an explanation thereof will be omitted. FIG. 13 is a functional block diagram illustrating an example of a first functional configuration of the image forming apparatus 2 according to the second exemplary embodiment. The functional blocks shown in FIG. 13 are implemented as a result of the CPU executing a developing bias correction processing program stored in the ROM of the controller 21. The developing bias correction processing program is a program for correcting a developing bias value on the basis of the toner image density detected by the density sensor 42.

A counter 411 counts the number of recording media on which image are formed on the surfaces thereof. A toner image density specifying section 412 specifies a density value of a toner image to be formed on the intermediate transfer belt 35. More specifically, the toner image density specifying section 412 instructs the image forming unit 26 to form a patch image and the density sensor 42 to read the formed patch image. The toner image density specifying section 412 specifies the density value of the toner image on the basis of a signal output from the density sensor 42. The toner image density specifying section 412 is an example of an "image density specifying unit" according to an exemplary embodiment of the invention. A calculator 413 compares the toner image density value specified by the toner image density specifying section 412 with a predetermined toner image density target value stored in the storage unit 22, and calculates the difference between the toner image density value and the toner image density target value ("toner image density target value"-"toner image density value").

A correcting section 414 corrects a developing bias. More specifically, the correcting section 414 specifies a correction amount for the developing bias on the basis of the difference calculated by the calculator 413 and the tables stored in the storage unit 22, and controls a developing bias value to be applied to the magnet roller 3321 of the developing device 33 on the basis of the correction amount. The correcting section 414 is an example of a "developing bias correcting unit" according to an exemplary embodiment of the invention.

The first functional configuration of the image forming apparatus 2 has been discussed above.

Figure 14:
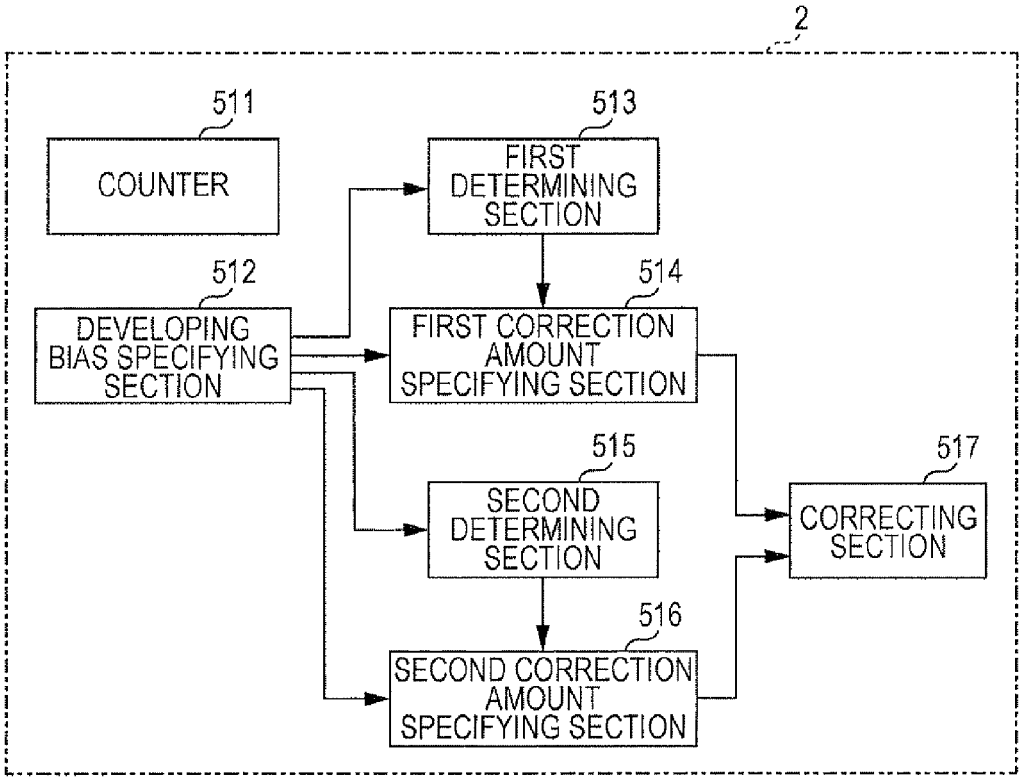
FIG. 14 is a functional block diagram illustrating an example of a second functional configuration of the image forming apparatus according to the second exemplary embodiment.

FIG. 14 is a functional block diagram illustrating an example of a second functional configuration of the image forming apparatus 2 according to the second exemplary embodiment. The functional blocks shown in FIG. 14 are implemented by the CPU executing a toner density target value correction processing program stored in the RAM of the controller 21. The toner density target value correction processing program is a program for correcting the toner density target value on the basis of a developing bias value.

A counter 511 counts the number of recording media on which images are formed on the surfaces thereof. A developing bias specifying section 512 specifies a value of a developing bias applied to the magnet roller 3321. The developing bias specifying section 512 is an example of a "developing bias specifying unit" according to an exemplary embodiment of the invention. A first determining section. 513 determines whether a developing bias value specified by the developing bias specifying section 512 is greater than a predetermined higher threshold stored in the RAM. If the determination result of the first determining section 513 is positive, a first correction amount specifying section 514 specifies a correction amount for the toner density target value. More specifically, the first correction amount specifying section 514 specifies the correction amount for the toner density target value on the basis of the difference between the developing bias value specified by the developing bias specifying section 512 and the higher threshold and the tables stored in the storage unit 22.

A second determining section 515 determines whether the developing bias value specified by the developing bias specifying section 512 is smaller than a predetermined lower threshold stored in the RAM. If the determination result of the second determining section 515 is positive, a second correction amount specifying section 516 specifies a correction amount for the toner density target value. More specifically, the second correction amount specifying section 516 specifies the correction amount for the toner density target value on the basis of the difference between the developing bias value specified by the developing bias specifying section 512 and the lower threshold and the tables stored in the storage unit 22. A correcting section 517 corrects the toner density target value on the basis of the correction value specified by the first correction amount specifying section 514 or the second correction amount specifying section 516. The correcting section 517 is an example of a "toner density target value correcting unit" according to an exemplary embodiment of the invention.

The second functional configuration of the image forming apparatus 2 has been discussed above.

Figure 15:
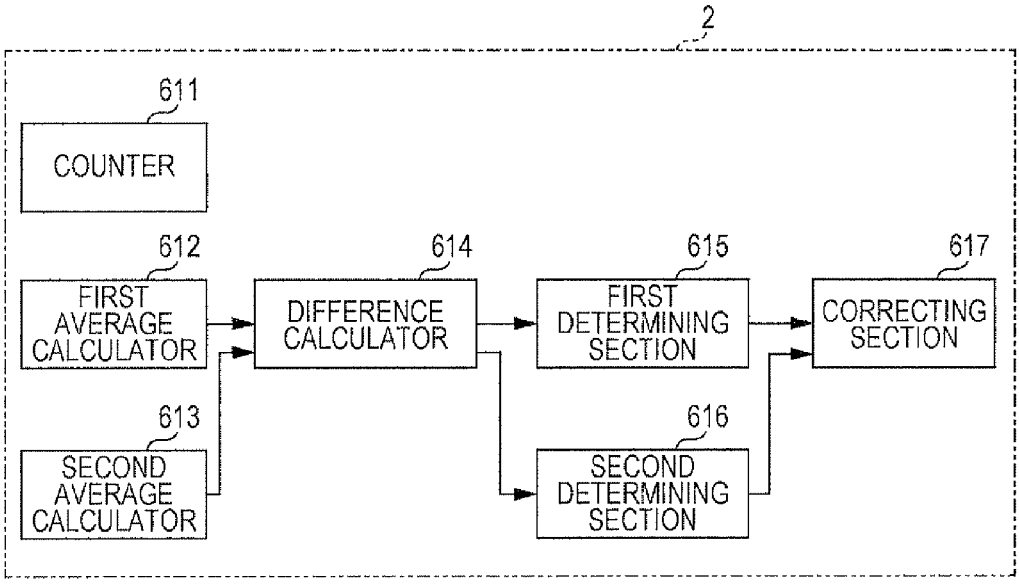
FIG. 15 is a functional block diagram illustrating an example of a third functional configuration of the image forming apparatus according to the second exemplary embodiment.

FIG. 15 is a functional block diagram illustrating a third functional configuration of the image forming apparatus 2 according to the second exemplary embodiment. The functional blocks shown in FIG. 15 are implemented as a result of the CPU executing a threshold correction processing program stored in the ROM of the controller 21. The threshold correction processing program is a program for correcting a threshold to determine whether to correct a toner density target value on the basis of a change in image density between images which have been output and images which will be output.

A counter 611 counts the number of recording media on which images are formed on the surfaces thereof. A first average calculator 612 calculates a first average of the image density values of plural images which have been output. More specifically, the first average calculator 612 reads image density values of images for, for example, 100 pages from the table TBL3 stored in the RAM, and calculates the average of the image density values. A second average calculator 613 calculates a second average of the image density values of plural images which will be output. More specifically, the second average calculator 613 reads image density values of images for, for example, 100 pages from the table TBL2 stored in the RAM, and calculates the average of the image density values. The second average calculator 613 is an example of a "calculator" according to an exemplary embodiment of the invention.

A difference calculator 614 calculates a difference between the first average value calculated by the first average calculator 612 and the second average value calculated by the second average calculator 613 ("first average value"–"second average value"). A first determining section 615 determines whether the absolute value of the difference calculated by the difference calculator 614 is greater than a predetermined threshold stored in the storage unit 22. This determination is made in order to determine whether a change in image density between images that have been output and images that will be output is greater than the predetermined threshold.

A second determining section 616 determines whether the difference calculated by the difference calculator 614 is a positive value. This determination is made in order to determine whether the image density will be increased or decreased. A correcting section 617 corrects the higher threshold or the lower threshold on the basis of a determination result of the second determining section 616. More specifically, if the determination result of the correcting section 617 is positive (i.e., if the image density will be decreased), the correcting section 617 corrects the lower threshold such that the lower threshold is decreased. As a result, it is less likely that the toner density target value will be corrected, compared with a case in which the lower threshold is not corrected. An amount by which the lower threshold is corrected is specified on the basis of the difference calculated by the difference calculator 614 and the tables stored in the storage unit 22.

In contrast, if the determination result of the second determining section 616 is negative (i.e., if the image density will be increased), the correcting section 617 corrects the higher threshold such that the higher threshold is increased. As a result, it is less likely that the toner density target value will be corrected, compared with a case in which the higher threshold is not corrected. An amount by which the higher threshold is corrected is specified on the basis of the difference calculated by the difference calculator 614 and the tables stored in the storage unit 22. The correcting section 617 is an example of a "correcting unit" according to an exemplary embodiment of the invention.

The third functional configuration of the image forming apparatus 2 has been discussed above.

2-2. Operation

A description will now be given of processing operations performed by the image forming apparatus 2 according to the second exemplary embodiment. More specifically, (a) toner density control processing, (b) developing bias correction processing, (c) toner density target value correction processing, and (d) threshold correction processing will be described. The above-described processing operations are performed as a result of the CPU executing the associated programs stored in the ROM of the image forming apparatus 2. The processing operations are performed concurrently with image forming processing performed by the image forming unit 26, and are performed in each of the developing devices 33 of the individual colors.

The (a) toner density control processing is the same as that of the first exemplary embodiment, and an explanation thereof will thus be omitted.

2-2-1. Developing Bias Correction Processing

Figure 16:
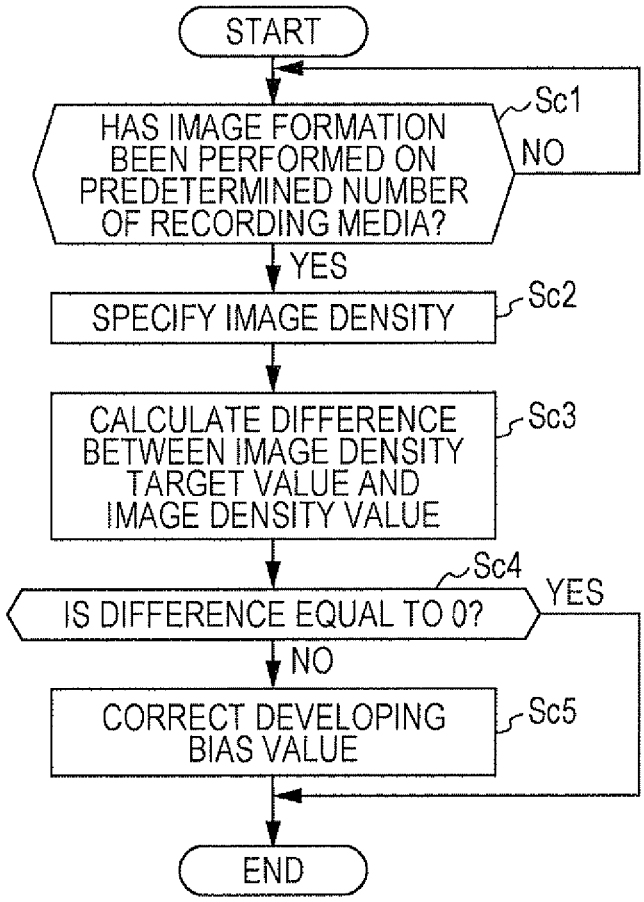
FIG. 16 is a flowchart illustrating developing bias correction processing.

FIG. 16 is a flowchart illustrating developing bias correction processing. This processing is performed in order to correct a developing bias value on the basis of the toner image density detected by the detection sensor 42. In step Sc1, the controller 21 of the image forming apparatus 2 determines whether image formation has been performed on a predetermined number of recording sheets. For example, the controller 21 determines whether image formation has been performed on ten recording sheets.

If it is determined in step Sc1 that image formation has not been performed on a predetermined number of recording sheets (if the result of Sc1 is NO), the controller 21 performs step Sc1 again. That is, the controller 21 enters the standby state until image formation has been performed on a predetermined number of recording sheets. If it is determined in step Sc1 that image formation has been performed on a predetermined number of recording sheets (if the result of Sc1 is YES), the process proceeds to step Sc2. In step Sc2, the controller 21 specifies a density value of a toner image. More specifically, in step Sc2, the controller 21 instructs the image forming unit 26 to form a patch image and the density sensor 42 to read the formed patch image. The controller 21 then specifies the density value of the toner image on the basis of a signal output from the density sensor 42.

Then, in step Sc3, the controller 21 compares the specified density value of the toner image with a predetermined toner image density target value and calculates a difference between the two values ("toner image density target value"–"toner image density value"). The controller 21 then determines in step Sc4 whether the calculated difference is 0. If the determination result of the controller 21 is positive (if the result of step Sc4 is YES), the controller 21 terminates the developing bias correction processing. If the determination result of the controller 21 is negative (if the result of step Sc4 is NO), the controller 21 executes step Sc5.

In step Sc5, the controller 21 corrects the developing bias value. The controller 21 specifies a correction amount for the developing bias value on the basis of the difference calculated in step Sc3 and the tables stored in the storage unit 22, and controls the value of the developing bias to be applied to the magnet roller 3321 of the developing device 3 on the basis of the correction amount.

The developing bias correction processing has been discussed above.

2-2-2. Toner Density Target Value Correction Processing

Figure 17:
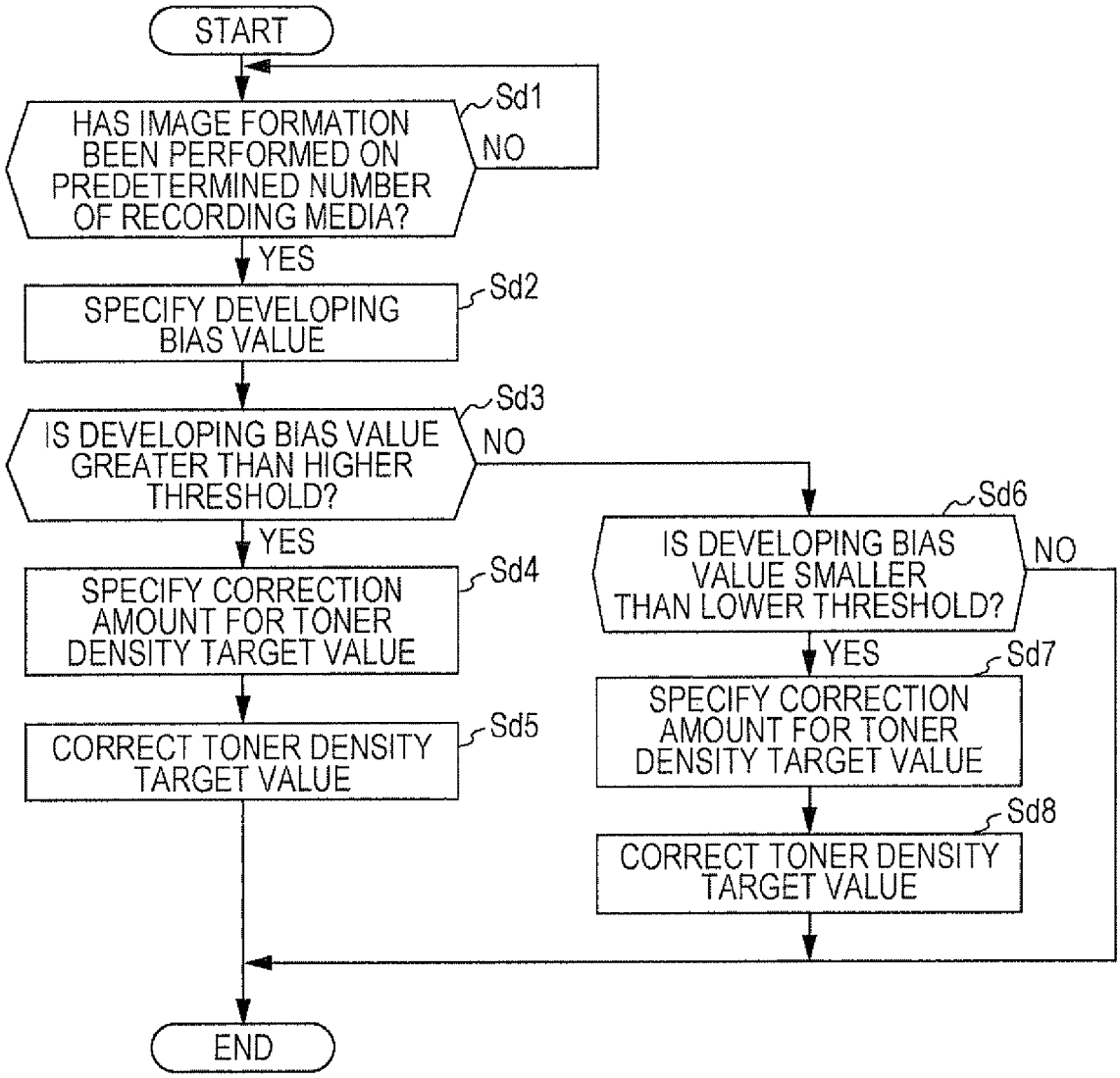
FIG. 17 is a flowchart illustrating toner density target value correction processing.

FIG. 17 is a flowchart illustrating toner density target value correction processing. This processing is performed in order to correct a toner density target value on the basis of a developing bias value. In step Sd1, the controller 21 of the image forming apparatus 2 determines whether image formation has been performed on a predetermined number of recording sheets. For example, the controller 21 determines whether image formation has been performed on ten recording sheets.

If it is determined in step Sd1 that image formation has not been performed on a predetermined number of recording sheets (if the result of step Sd1 is NO), the controller 21 executes step Sd1 again. That is, the controller 21 enters the standby state until image formation has been performed on a predetermined number of recording sheets. In contrast, if it is determined in step Sd1 that image formation has been performed on a predetermined number of recording sheets (if the result of step Sd1 is YES), the process proceeds to step Sd2. In step Sd2, the controller 21 specifies a developing bias value. Then, the controller 21 determines in step Sd3 whether the specified developing bias value is greater than a predetermined higher threshold stored in the RAM.

If it is determined in step Sd3 that the specified developing bias value is greater than the predetermined higher threshold, the process proceeds to step Sd4. In step Sd4, the controller 21 specifies an amount by which the toner density target value is corrected. More specifically, the controller 21 specifies a correction amount for the toner density target value on the basis of the difference between the higher threshold and the developing bias value and the tables stored in the storage unit 22. Then, in step Sd5, the controller 21 corrects the toner density target value on the basis of the specified correction amount. In contrast, if it is determined in step Sd3 that the specified developing bias value is not greater than the higher threshold, the process proceeds to step Sd6. The controller 21 determines in step Sd6 whether the developing bias value is smaller than a predetermined lower threshold stored in the RAM.

If it is determined in step Sd6 that the specified developing bias value is smaller than the predetermined lower threshold, the process proceeds to step Sd7. In step Sd7, the controller 21 specifies a correction amount for the toner density target value on the basis of the difference between the lower threshold and the developing bias value and the tables stored in the storage unit 22. Then, in step Sd8, the controller 21 corrects the toner density target value on the basis of the specified correction amount. In contrast, if it is determined in step Sd6 that the specified developing bias value is not smaller than the lower threshold, the controller 21 terminates the toner density target value correction processing without correcting the toner density target value.

The toner density target value correction processing has been discussed above.

2-2-3. Threshold Correction Processing

Figure 18:
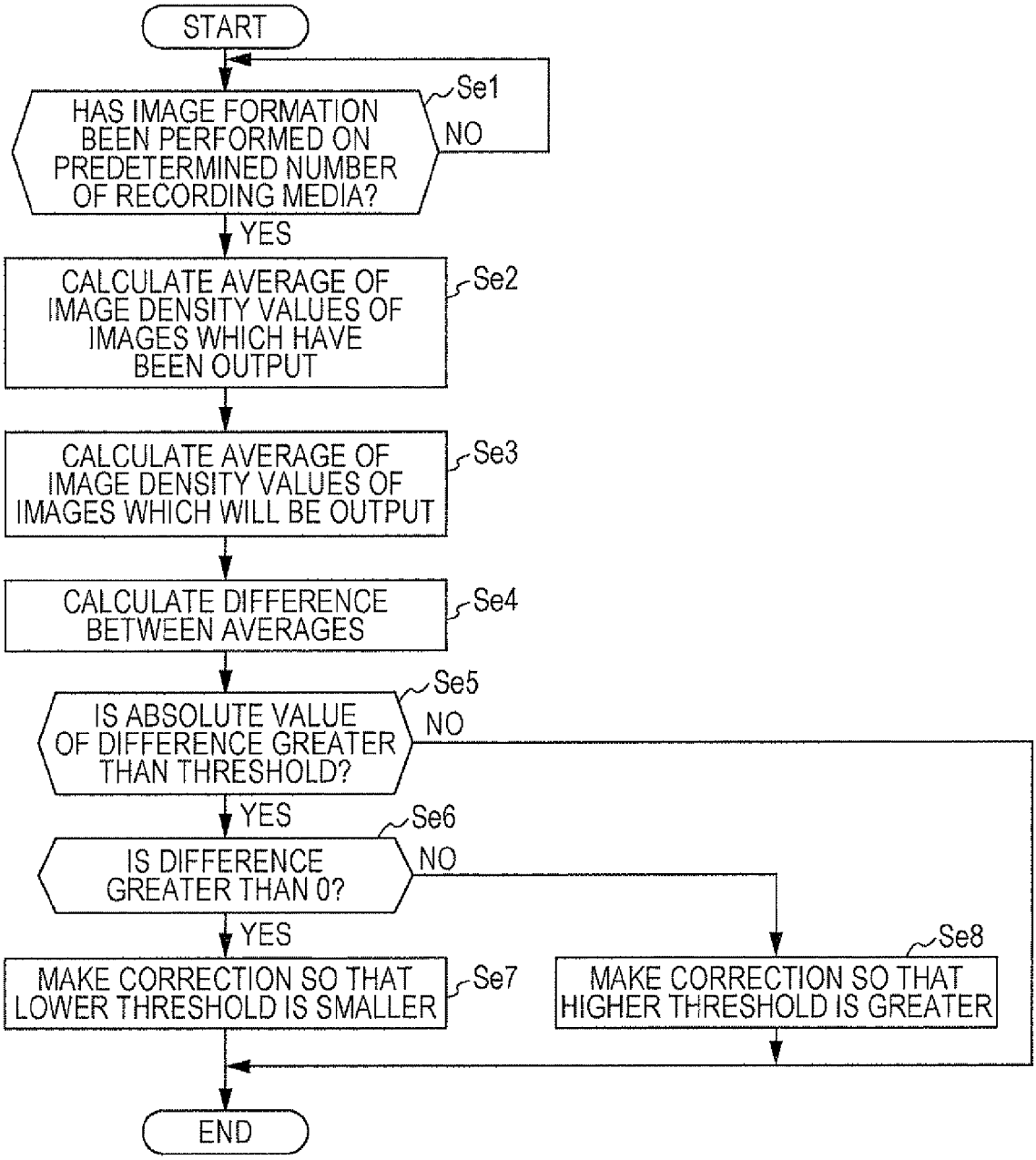
FIG. 18 is a flowchart illustrating threshold correction processing.

FIG. 18 is a flowchart illustrating threshold correction processing. This processing is performed in order to correct a threshold used for determining whether to correct the toner density target value, on the basis of a change in image density between images which have been output and images which will be output. In step Se1, the controller 21 of the image forming apparatus 2 determines whether image formation has been performed on a predetermined number of recording sheets. For example, the controller 21 determines whether image formation has been performed on ten recording sheets.

If it is determined in step Se1 that image formation has not been performed on a predetermined number of recording sheets (if the result of step Se1 is NO), the controller 21 executes step Se1 again. That is, the controller 21 enters the standby state until image formation has been performed on a predetermined number of recording sheets. In contrast, if it is determined in step Se1 that image formation has been performed on a predetermined number of recording sheets (if the result of step Se1 is YES), the process proceeds to step Se2.

In step Se2, the controller 21 calculates a first average of the image density values of plural images which have been output. More specifically, the controller 21 reads image density values of images for, for example, 100 pages, from the table TBL3 stored in the RAM, and calculates the average of the image density values. Then, in step Se3, the controller 21 calculates a second average of the image density values of plural images which will be output. More specifically, the controller 21 reads image density values of images for, for example, 100 pages, from the table TBL2 stored in the RAM, and calculate the average of the image density values.

In step Se4, the controller 21 calculates the difference between the first average value calculated in step Se2 and the second average value calculated in step Se3 ("first average value"–"second average value"). The controller 21 then determines in step Se5 whether the absolute value of the calculated difference is greater than a predetermined threshold. That is, the controller 21 determines in step Se5 whether a change in image density between images which have been output and images which will be output is greater than the predetermined threshold. If it is determined in step Se5 that the absolute value of the calculated difference is not greater than the predetermined threshold (if the result of step Se5 is NO), the controller 21 terminates the threshold correction processing without correcting the threshold. If it is determined in step Se5 that the absolute value of the calculated difference is greater than the predetermined threshold (if the result of step Se5 is YES), the process proceeds to step Se6. In step Se6, the controller 21 determines whether the calculated difference is a positive value.

If it is determined in step Se6 that the calculated difference is a positive value (i.e., if the image density will be decreased), the process proceeds to step Se7. In step Se7, the controller 21 corrects the lower threshold such that the lower threshold is decreased. As a result, it is less likely that the toner density target value will be corrected, compared with a case in which the lower threshold is not corrected. If it is determined in step Se6 that the calculated difference is not a positive value (i.e., if the image density will be increased), the process proceeds to step Se8. In step Se8, the controller 21 corrects the higher threshold such that the higher threshold is increased. As a result, it is less likely that the toner density target value will be corrected, compared with a case in which the higher threshold is not corrected.

The threshold correction processing has been discussed above.

In the above-described second exemplary embodiment, if a change in image density between images that have been output and images that will be output is greater than the threshold, the threshold used for determining whether to correct the toner density target value is corrected such that it is less likely that the toner density target value will be corrected. As a result, a change in the toner density caused by the correction for the toner density target value is suppressed. Additionally, intentional consumption of toner for the purpose of decreasing the toner density is avoided, thereby preventing toner from being wasted.

3. Modified Examples

The above-described exemplary embodiments may be modified as follows. Additionally, the following modified examples may be combined.

3-1. First Modified Example

Figure 19:
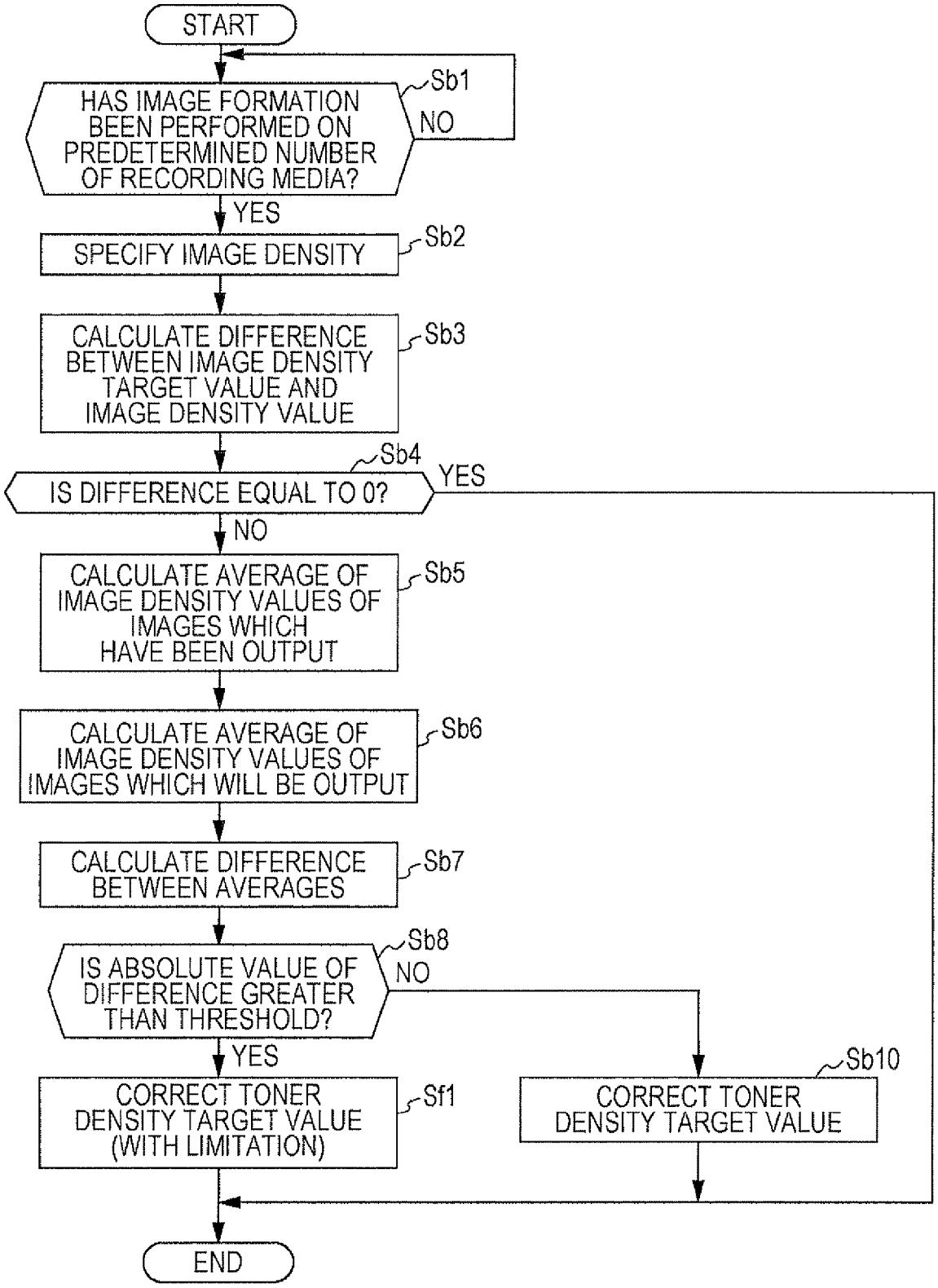
FIG. 19 is a flowchart illustrating toner density target value correction processing of a first modified example.

In the toner density target value correction processing of the first exemplary embodiment, the toner density target value is not corrected when a change in image density between images which have been output and images which will be output is greater than a threshold. However, in a first modified example, a correction amount for the toner density target value may be restricted, instead of not correcting the toner density target value whatsoever. FIG. 19 is a flowchart illustrating toner density target value correction processing of the first modified example. In FIG. 19, the same steps as those of FIG. 11 are indicated by like step numbers, and an explanation thereof will thus be omitted.

If it is determined in step Sb8 that the absolute value of the calculated difference is greater than a threshold (if the result of step Sb8 is YES), the process proceeds to step Sf1. In step Sf1, instead of correcting the tone correction table, the toner density target value is corrected. In this case, however, the toner density target value is corrected on the basis of a smaller correction amount (e.g., 50% of the correction amount in step Sb10). The controller 21 is an example of a "correction amount specifying unit" and a "correcting unit" according to an exemplary embodiment of the invention.

3-2. Second Modified Example

In the second exemplary embodiment, a change in the toner density is suppressed by correcting a threshold used for determining whether to correct the toner density target value. Instead, in a second modified example, a change in the toner density may be suppressed by limiting a correction amount for the toner density target value. In this case, among the four types of processing, the toner density target value correction processing may be modified as follows, and the threshold correction processing may be omitted. The toner density target value correction processing in the second modified example will be discussed below.

Figure 20:
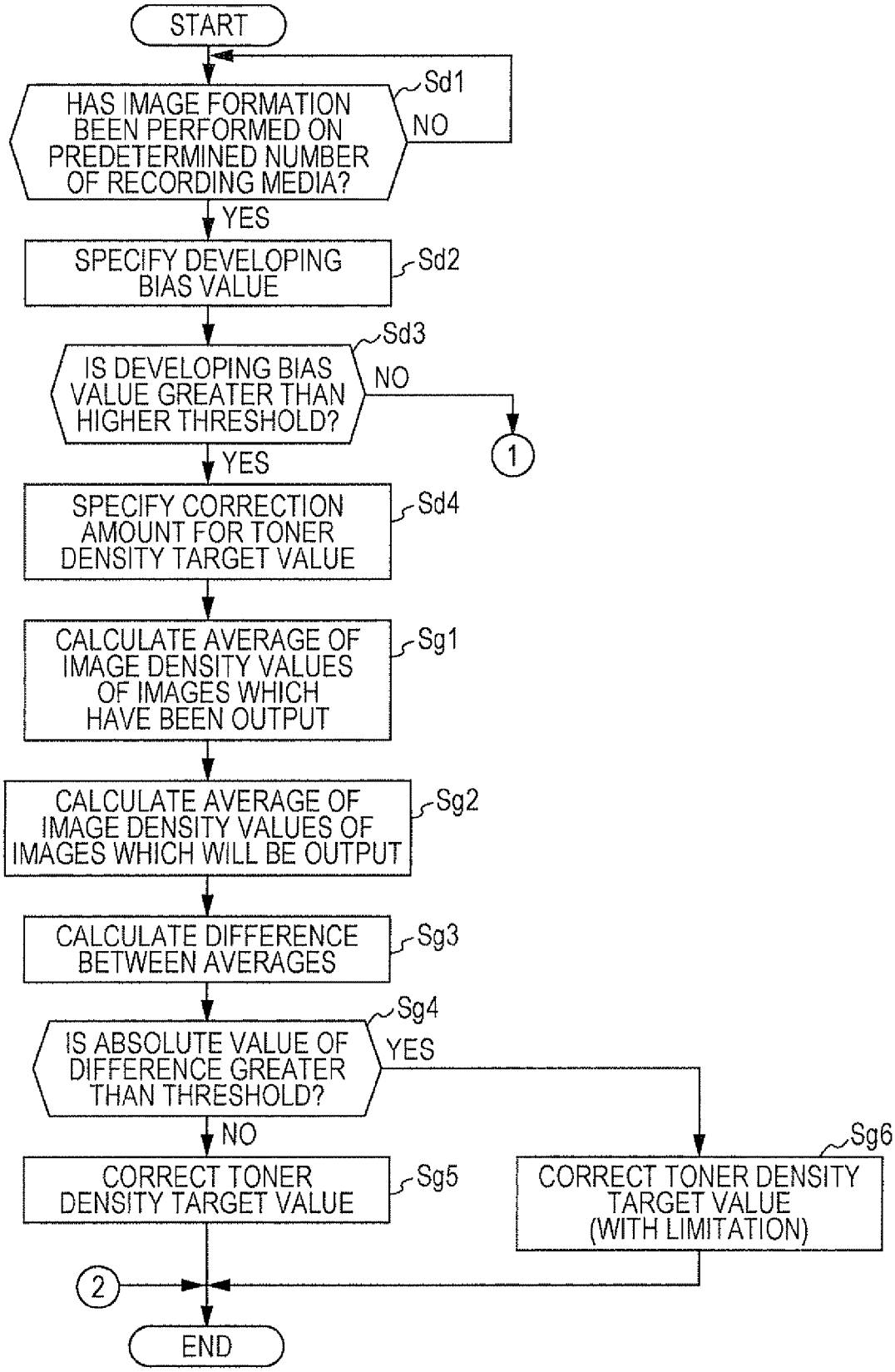
FIGS. 20 and 21 are flowcharts illustrating toner density target value correction processing of a second modified example.
Figure 21:
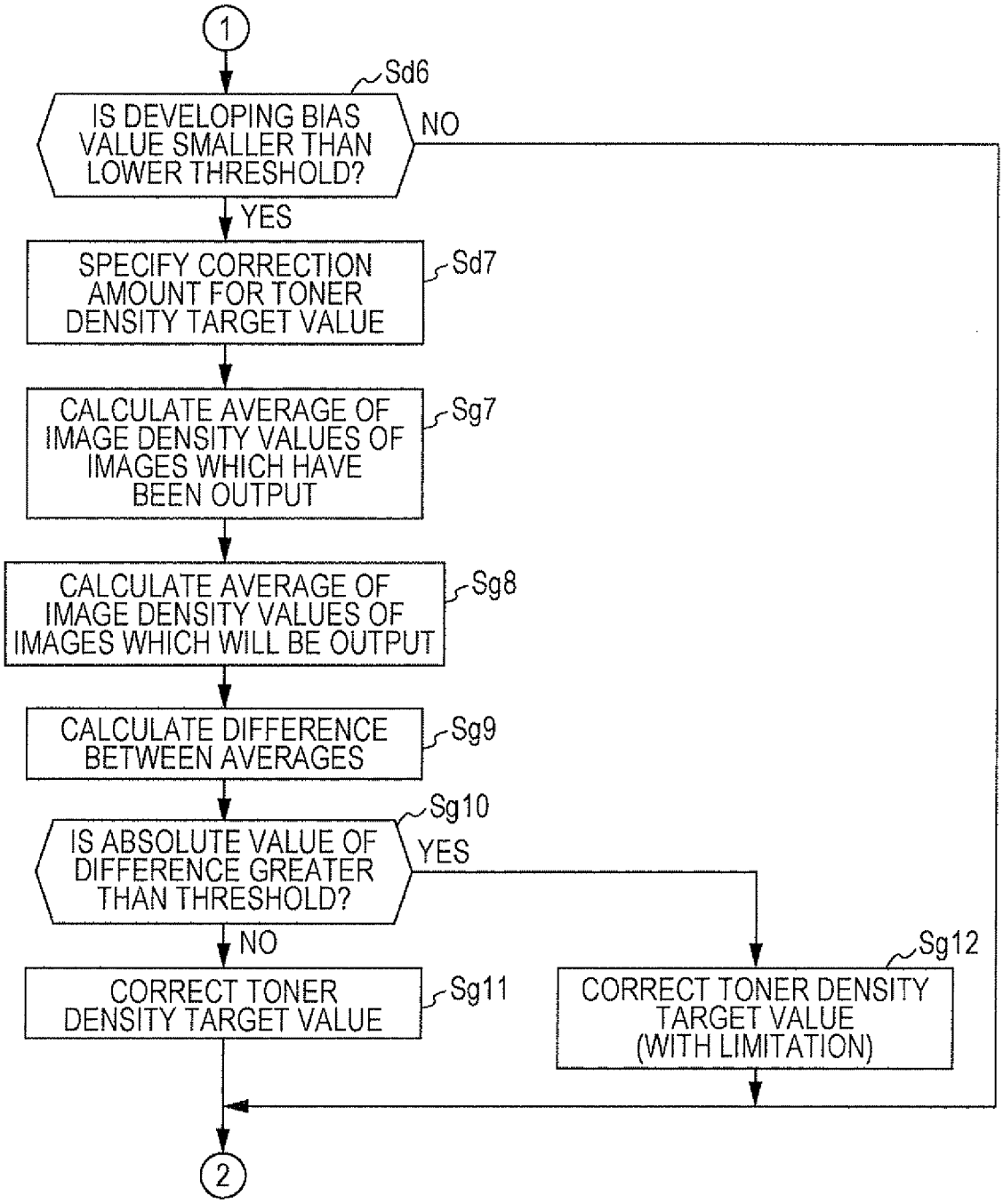

FIGS. 20 and 21 are flowcharts illustrating the toner density target value correction processing of the second modified example. In FIGS. 20 and 21, the same steps as those shown in FIG. 17 are designated by like step numbers, and an explanation thereof will thus be omitted. In the second modified example, if it is determined in step Sd3 that the specified developing bias value is greater than the higher threshold, in step Sd4, the controller 21 specifies a correction amount for the toner density target value. Then, in step Sg1, the controller 21 calculates a first average value of the image density values of plural images which have been output. Then, in step Sg2, the controller 21 calculates a second average value of the image density values of plural images which will be output.

In step Sg3, the controller 21 then calculates the difference between the first average value calculated in step Sg1 and the second average value calculated in step Sg2 ("first average value"–"second average value"). Then, the controller 21 determines in step Sg4 whether the absolute value of the calculated difference is greater than a predetermined threshold. If it is determined in step Sg4 that the absolute value of the calculated difference is not greater than the predetermined threshold (if the result of step Sg4 is NO), the process proceeds to step Sg5. In step Sg5, the controller 21 corrects the toner density target value. More specifically, the controller 21 corrects the toner density target value on the basis of the correction amount specified in step Sd4.

In contrast, if it is determined in step Sg4 that the absolute value of the calculated difference is greater than the predetermined threshold (if the result of step Sg4 is YES), the process proceeds to step Sg6. In step Sg6, the controller 21 corrects the toner density target value with a limited amount of correction. More specifically, the controller 21 corrects the toner density target value on the basis of a smaller correction amount (e.g., 50% of the correction amount in step Sg5).

The correction of the toner density target value is performed as described above when the specified developing bias value is greater than the higher threshold. When the specified developing bias value is smaller than the lower threshold, a change in image density between images which have been output and images which will be output is also calculated. This will be discussed below with reference to FIG. 21.

If it is determined in step Sd6 that the specified developing bias value is smaller than the lower threshold, the controller 21 specifies a correction amount for the toner density target value in step Sd7. Then, in step Sg7, the controller 21 calculates a first average value of the image density values of plural images which have been output. Then, in step Sg8, the controller 21 calculates a second average value of the image density values of plural images which will be output.

In step Sg9, the controller 21 calculates a difference between the first average value calculated in step Sg7 and the second average value calculated in step Sg8 ("first average value"–"second average value"). Then, the controller 21 determines in step Sg10 whether the absolute value of the calculated difference is greater than a predetermined threshold. If it is determined in step Sg10 that the absolute value of the calculated difference is not greater than the predetermined threshold (if the result of step Sg10 is NO), the process proceeds to step Sg11. In step Sg11, the controller 21 corrects the toner density target value. More specifically, the controller 21 corrects the toner density target value on the basis of the correction amount specified in step Sd4.

In contrast, if it is determined in step Sg10 that the absolute value of the calculated difference is greater than the predetermined threshold (if the result of step Sg10 is YES), the process proceeds to step Sg12. In step Sg12, the controller 21 corrects the toner density target value with a limited amount of correction. More specifically, the controller 21 corrects the toner density target value on the basis of a smaller correction amount (e.g., 50% of the correction amount in step Sg11).

3-3. Third Modified Example

In the toner density target value correction processing of the first exemplary embodiment, the average value of the image density values of images which have been output and the average value of the image density values of images which will be output are calculated, and then, by comparing the difference between the two average values with the threshold, it is determined whether to correct the toner density target value (steps Sb5 through Sb8 in FIG. 11). Alternatively, instead of the average value of image density values of images, a cumulative value of image density values of images may be used. More specifically, a cumulative value of image density values of images which have been output and a cumulative value of image density values of images which will be output may be calculated. Then, by comparing the difference between the two cumulative values with a threshold, it may be determined whether to correct the toner density target value. Additionally, in the threshold correction processing in the second exemplary embodiment, instead of the average value of image density values of images, the cumulative value of image density values of images may be used. More specifically, the cumulative value of image density values of images which have been output and the cumulative value of image density values of images which will be output may be calculated. Then, by comparing the difference between the two cumulative values with a threshold, it may be determined whether to correct the threshold (steps Se2 through Se5 in FIG. 18).

3-4. Fourth Modified Example

In the toner density control processing of the first exemplary embodiment, it is determined in step Sa1 whether image formation has been performed on a predetermined number of recording sheets. If the determination of step Sa1 is positive, step Sa2 is executed. Alternatively, in a fourth modified example, in step Sa1, it may be determined whether a predetermined time has elapsed, and if the determination of step Sa1 is positive, step Sa2 may be executed. Steps Sb1, Sc1, Sd1, and Se1 may be executed in a manner similar to step Sa1 of the fourth modified example. If the determination of step Sa1 is negative, step Sa1 is executed again.

3-5. Fifth Modified Example

In the toner density target value correction processing of the first exemplary embodiment, if a change in image density between images which have been output and images which will be output is greater than a predetermined threshold, the tone correction table is corrected instead of the toner density target value. However, in a fifth modified example, instead of the tone correction table, a developing bias value may be corrected. In this case, a correction amount for the developing bias value may be specified on the basis of the difference between the image density detected by the density sensor 42 and the image density target value and the tables stored in the storage unit 22.

3-6. Sixth Modified Example

In the toner density target value correction processing of the first exemplary embodiment, the average value of the image density values of images which have been output and the average value of the image density values of images which will be output are calculated, and then, by comparing the difference between the two average values with the threshold, it is determined whether to correct the toner density target value (steps Sb5 through Sb8 in FIG. 11). In a sixth modified example, however, only the average value of the image density values of images which will be output may be calculated without calculating the average value of the image density values of images which have been output, and the difference between the calculated average value and a predetermined value may be determined. Then, by comparing the difference with a threshold, it may be determined whether to correct the toner density target value. The predetermined value may be a value set by a user in advance as a standard image density (e.g., 5%).

The sixth modified example will be described below with reference to the flowchart of FIG. 11. In this modified example, step Sb5 is omitted. In step Sb7, instead of the first average value calculated in step Sb5, the difference between the predetermined value and the second average value calculated in step Sb6 ("predetermined value" "second average value") is calculated.

In the above-described threshold correction processing of the second exemplary embodiment, the calculation of the average value of the image density values of images which have been output may be omitted. This will be described below with reference to the flowchart of FIG. 18. Step Se2 is omitted, and in step Se4, the difference between the second average value calculated in step Se3 and a predetermined value ("predetermined value"–"second average value") may be calculated. As described above, the predetermined value may be a value set by a user in advance as a standard image density (e.g., 5%).

3-7. Seventh Modified Example

The programs executed by the CPU of the image forming apparatus 2 in the first and second exemplary embodiments and the modified examples may be provided as a result of being stored in a storage medium, such as magnetic tape, a magnetic disk, a flexible disk, an optical disc, a magneto-optical disk, or a memory, and may be installed in the image forming apparatus 2. The programs may be downloaded into the image forming apparatus 2 via a communication line, such as the Internet.

The foregoing description of the exemplary embodiments and the modified examples of the present invention has been provided for the purposes of illustration and description. It is not intended to be exhaustive or to limit the invention to the precise forms disclosed. Obviously, many modifications and variations will be apparent to practitioners skilled in the art. The embodiments and modified examples were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A control apparatus comprising:

a toner density specifying unit that specifies a toner density in a developer which includes a toner and a carrier, the developer being stored in a developing device, the developing device developing an image by using the developer so as to form a toner image;

a toner density controller that performs control such that the toner density specified by the toner density specifying unit approximates a predetermined toner density target value;

a first calculator that calculates a value corresponding to an image density of an image which is to be output after a timing;

a correction amount specifying unit that specifies a correction amount for the predetermined toner density target value at the timing, when a condition that an absolute value of a difference between the first value and a second value, which serves as a reference value, used for specifying the correction amount for the predetermined toner density target value, is greater than a predetermined threshold is satisfied, the correction amount specifying unit specifying a smaller correction amount for the predetermined toner density target value, compared with when the condition is not satisfied; and a correcting unit that corrects the predetermined toner density target value on the basis of the correction amount specified by the correction amount specifying unit.

2. The control apparatus according to claim 1, further comprising:

a second calculator that calculates, as the second value, a third value corresponding to an image density of an image which has been output before the timing.

3. The control apparatus according to claim 2, wherein:

the developing device develops an image by using the developer as a result of applying a developing bias to the developing device; and the correcting unit corrects a value of the developing bias to be applied to the developing device when the condition is satisfied.

4. An image forming apparatus comprising:

an image carrier;

a charging device that charges a surface of the image carrier;

an exposure device that exposes the surface of the image carrier charged by the charging device to light and forms an electrostatic latent image;

a developing device that stores a developer which includes a toner and a carrier and that develops the electrostatic latent image formed by the exposure device by using the developer so as to form a toner image;

a transfer device that transfers the toner image formed by the developing device to a recording medium;

a toner density specifying unit that specifies a toner density in the developer stored in the developing device;

a toner density controller that performs control such that the toner density specified by the toner density specifying unit approximates a predetermined toner density target value;

a calculator that calculates a first value corresponding to an image density of an image which is to be output after a timing;

a correction amount specifying unit that specifies a correction amount for the predetermined toner density target value at the timing, when a condition that an absolute value of a difference between the first value and a second value, which serves as a reference value, used for specifying the correction amount for the predetermined toner density target value, is greater than a predetermined threshold is satisfied, the correction amount specifying unit specifying a smaller correction amount for the predetermined toner density target value, compared with when the condition is not satisfied; and a correcting unit that corrects the predetermined toner density target value on the basis of the correction amount specified by the correction amount specifying unit.

5. An image forming system comprising:

an image forming apparatus; and an image processing apparatus that performs image processing on image data which is to be transmitted to the image forming apparatus, the image forming apparatus including an image carrier, a charging device that charges a surface of the image carrier, an exposure device that exposes the surface of the image carrier charged by the charging device to light and forms an electrostatic latent image, a developing device that stores a developer which includes a toner and a carrier and that develops the electrostatic latent image formed by the exposure device by using the developer so as to form a toner image, a transfer device that transfers the toner image formed by the developing device to a recording medium, a toner density specifying unit that specifies a toner density in the developer stored in the developing device, a toner density controller that performs control such that the toner density specified by the toner density specifying unit approximates a predetermined toner density target value, a calculator that calculates a first value corresponding to an image density of an image which is to be output after a timing, a correction amount specifying unit that specifies a correction amount for the predetermined toner density target value at the timing, when a condition that an absolute value of a difference between the first value and a second value, which serves as a reference value, used for specifying the correction amount for the predetermined toner density target value, is greater than a predetermined threshold is satisfied, the correction amount specifying unit specifying a smaller correction amount for the predetermined toner density target value, compared with when the condition is not satisfied, a correcting unit that corrects the predetermined toner density target value on the basis of the correction amount specified by the correction amount specifying unit, and a receiver that receives image density information indicating an image density of an image from the image processing apparatus.

6. A control method comprising:

specifying a toner density in a developer which includes a toner and a carrier, the developer being stored in a developing device, the developing device developing an image by using the developer so as to form a toner image;

performing control such that the specified toner density approximates a predetermined toner density target value;

calculating a first value corresponding to an image density of an image which is to be output after a timing;

specifying a correction amount for the predetermined toner density target value at the timing, when a condition that an absolute value of a difference between the first value and a second value, which serves as a reference value, used for specifying the correction amount for the predetermined toner density target value, is greater than a predetermined threshold is satisfied, specifying a smaller correction amount for the predetermined toner density target value, compared with when the condition is not satisfied; and correcting the predetermined toner density target value on the basis of the specified correction amount.

7. A computer readable medium storing a program causing a computer to execute a process, the process comprising:

specifying a toner density in a developer which includes a toner and a carrier, the developer being stored in a developing device, the developing device developing an image by using the developer so as to form a toner image;

performing control such that the specified toner density approximates a predetermined toner density target value;

calculating a first value corresponding to an image density of an image which is to be output after a timing;

specifying a correction amount for the predetermined toner density target value at the timing, when a condition that an absolute value of a difference between the first value and a second value, which serves as a reference value, used for specifying the correction amount for the predetermined toner density target value, is greater than a predetermined threshold is satisfied, specifying a smaller correction amount for the predetermined toner density target value, compared with when the condition is not satisfied; and correcting the predetermined toner density target value on the basis of the specified correction amount.

8. A control apparatus comprising:

a toner density specifying unit that specifies a toner density in a developer which includes a toner and a carrier, the developer being stored in a developing device, the developing device developing an image by using the developer as a result of applying a developing bias to the developing device;

a toner density controller that performs control such that the toner density specified by the toner density specifying unit approximates a predetermined toner density target value;

an image density specifying unit that specifies a density of an image to be developed by the developing device;

a developing bias correcting unit that corrects a value of the developing bias to be applied to the developing device on the basis of the density of the image specified by the image density specifying unit;

a toner density target value correcting unit that corrects the predetermined toner density target value when the value of the developing bias corrected by the developing bias correcting unit is not within a predetermined range;

a calculator that calculates a first value corresponding to an image density of an image which is to be output after a timing; and a correcting unit that corrects the range at the timing, and that corrects the predetermined range such that the predetermined range is increased when a condition that an absolute value of a difference between the first value and a second value, which serves as a reference value, used for specifying a correction amount for the predetermined range, is greater than a predetermined threshold is satisfied.

* * * * *